US006336698B1

(12) United States Patent
Imai

(10) Patent No.: US 6,336,698 B1
(45) Date of Patent: Jan. 8, 2002

(54) PRINTER HAVING A REPLACEABLE HEAD UNIT AND CAPING MECHANISM THEREFOR

(75) Inventor: Koji Imai, Inuyama (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 0 days.

(21) Appl. No.: 09/186,445

(22) Filed: Nov. 5, 1998

(30) Foreign Application Priority Data

| | | |
|---|---|---|
| Nov. 7, 1997 | (JP) | 9-305880 |
| Nov. 7, 1997 | (JP) | 9-305881 |
| Nov. 7, 1997 | (JP) | 9-305882 |
| Jan. 28, 1998 | (JP) | 10-015681 |
| Oct. 8, 1998 | (JP) | 10-286538 |

(51) Int. Cl.[7] ..... B41J 2/165
(52) U.S. Cl. ..... 347/32
(58) Field of Search ..... 347/29, 30, 32, 347/24, 86, 49, 87, 37

(56) References Cited

U.S. PATENT DOCUMENTS

| | | | | |
|---|---|---|---|---|
| 5,055,856 A | * | 10/1991 | Tomii et al. | 347/30 |
| 5,260,724 A | * | 11/1993 | Tomii et al. | 347/30 |
| 5,359,357 A | * | 10/1994 | Takagi et al. | 347/49 |
| 5,448,271 A | * | 9/1995 | Yamaguchi et al. | 347/30 |
| 5,844,687 A | * | 12/1998 | Nagane et al. | 358/296 |
| 5,861,901 A | * | 1/1999 | Kashimura et al. | 347/50 |
| 5,872,578 A | * | 2/1999 | Takata | 347/29 |
| 5,889,536 A | * | 3/1999 | Sasaki | 347/30 |
| 6,010,203 A | * | 1/2000 | Muraki | 347/30 |

* cited by examiner

*Primary Examiner*—Judy Nguyen
(74) *Attorney, Agent, or Firm*—Oliff & Berridge, PLC

(57) ABSTRACT

An ink jet printer incudes a carriage supported slidably in opposite reciprocating directions and having a turning axis which extends in these directions. The printer also includes a head holder a and a head unit. The unit is fixed to the front wall of the holder, and has print heads. The printer further includes protective caps for covering the ejection faces of the heads respectively. When the heads are replaced at their position where their ejection faces are opposite the caps the caps are oriented opposite the direction in which the holder is moved toward the axis. When the holder is put on the carriage in such a direction that the holder approaches the caps the caps cap the heads. The caps can move in the directions in which the holder turn. After part of the holder is put on the carriage, the holder is turned around the axis to its normal position, where the heads correctly face the printing position on printing paper. The holder turns together with the caps with the heads capped with them. The cap does not rub on the ejection faces of the heads.

9 Claims, 21 Drawing Sheets

PRINTER HAVING A REPLACEABLE HEAD UNIT AND CAPING MECHANISM THEREFOR

BACKGROUND OF THE INVENTION

1. Field of the Invention

The present invention relates to an ink jet printer having an exchangable printing head.

2. Description of Related Art

A known ink jet printer includes a carriage, which can reciprocate horizontally along a printing medium. A head holder is mounted removably on the carriage, and supports print heads on it. The heads can eject ink onto the medium. The printer also includes a capping device, which includes protective caps for covering the ejection faces of the heads to prevent the ink on and in the heads from drying. There may be cases where the heads need to be replaced because of their lives, trouble, etc.

FIGS. 20, 21A, 21B, 21C, 22A and 22B of the accompanying drawings show a known ink jet printer of the foregoing type. As shown in FIG. 20, the printer includes a carriage 103, a head holder 102 mounted removably on the carriage 103, and print heads 101 (only one shown) supported on the holder 102. Each head 101 has an ejection face 101*a* (FIGS. 22A and 22B) and an array of nozzles (not shown) formed in it. The front ends of the nozzles are open in the ejection face 101*a*. The holder 102 includes a pair of side walls 107. The carriage 103 includes a pair of side walls 106. The printer also includes protective caps 105 each for covering one of the ejection faces 101*a*. The caps 105 are positioned outside one edge of the path along which a printing medium moves. The caps 105 are supported at a fixed position, but with such slight play that they can incline forward and backward for close contact with the ejection faces 101*a*.

The printer includes mounting mechanism 104 provided between the head holder 102 and the carriage 103 to mount the holder on the carriage. The mounting mechanism 104 include a pair of grooves 106*a* each formed on the inner side of one of the carriage walls 106. The front end of each groove 106*a* is closed, and the rear end is open and wider than the front end. The mounting mechanism 104 also include a pair of horizontal pins 107*a* each formed on one of the holder walls 107 to engage slidably with the adjacent groove 106*a*.

It is possible to mount the head holder 102 on the carriage 103 by:

moving the holder 102 toward the protective caps 105, as shown in FIGS. 21A and 21B, with the holder pins 107*a* engaged with the carriage grooves 106*a*; and then turning the holder 102 around its pins 107*a* clockwise in FIGS. 21A and 21B to bring the print heads 101 to the normal position shown in FIG. 21C, where the heads correctly face the printing position on the printing medium.

One might consider replacing the print heads 101 after moving the carriage 103 to a position where it faces the printing medium path. In such a case, it would be necessary to put the head holder 102 on the carriage 103 in a direction inclined with respect to the medium path, in such a manner that the upper edges of the heads 101 might move toward the medium path beyond the normal position of the heads 101. It would then be necessary to turn the inclined holder 102 to its normal position. When the upper edges of the heads 101 move toward the medium path, however, they would impinge on the printing medium, because the ejection faces 101*a* are normally spaced only about 2 mm from the path. It would consequently be impossible to replace the heads 101 when the carriage 103 faces the medium path.

Therefore, the print heads 101 can be replaced at their position where their ejection faces 101*a* are covered with the protective caps 105. The head replacement involves:

removing the head holder 102 from the carriage 103;

providing a new head holder 102 supporting new print heads 101;

engaging the horizontal pins 107*a* of the new holder 102 with the carriage grooves 106*a*, as shown in FIG. 22A, with the heads 101 inclined with respect to their normal position;

then moving the holder 102 until a portion over the ejection face 101*a* of each head 101 comes into contact with the upper edge of the associated protective cap 105;

further moving the holder 102, as shown in FIG. 22B, so that each cap 105 inclines around its upper edge and parallels the associated ejection face 101*a*; and then turning the holder 102 around the pins 107*a* clockwise in FIGS. 22A and 22B to bring the heads 101 into the normal position, moving the ejection faces 101*a* upward.

When the ejection faces 101*a* move up, the caps 105, which are supported at their fixed position, rub on the faces. This may force dust etc. on the caps 105 and the ejection faces 101*a* into the head nozzles. Therefore, there is need for strong purging every time the heads 101 have been replaced. There may be cases where such purging is not sufficient to remove dust etc.

SUMMARY OF THE INVENTION

It is an object of the invention to provide an ink jet printer of which the print head can be replaced without the protective cap rubbing on the ejection face of the head.

In accordance with a first aspect of the invention, a printer is provided, which includes a carriage movable in opposite reciprocating directions. The carriage has a turning axis extending in the reciprocating directions. A head holder can be mounted on the carriage, and holds a print head. The head has an ejection face and a nozzle for ejecting ink onto a printing medium. The nozzle is open in the ejection face. The printer also includes a capping mechanism, which includes a protective cap for covering the ejection face. The head holder can be mounted on the carriage with a mounting mechanism by a process including the steps of:

moving the holder toward the turning axis until part of the holder arrives at the axis and until the ejection face comes into contact with the protective cap; and thereafter turning the head holder around the axis.

The protective cap is supported in such a manner:

that, while out of contact with the ejection face, the cap is oriented opposite the direction in which the head holder can be moved toward the turning axis; and that, while the holder is turned, the cap can turn in the turning directions in which the holder turns.

As stated above, the protective cap of this printer is supported in such a manner that, while it is out of contact with the ejection face, that is to say, while the head holder is not mounted on the carriage, the cap is oriented opposite the direction in which the head holder can be moved toward the turning axis. For replacement of the print head, a new head holder holding a new print head is first moved to the turning axis until part of the holder engages with the carriage. When the holder part engages with the carriage, the ejection face of this head faces and comes into close contact with the cap, as shown in FIG. 9B of the accompanying drawings. Subsequently, while the head holder is turned around the axis, the protective cap is turned, kept in contact with the ejection face. Therefore, while the head holder is turned, the protective cap does not slide on the ejection face. This prevents the nozzle from clogging due to the cap slide or slip.

In particular, the capping mechanism of this printer may be so designed that, when the print head is replaced, the front edge of the protective cap can follow the locus of the ejection face moving while the head holder is turning around the turning axis.

The capping mechanism may also include a casing. A cap holder for holding the protective cap may be supported by the casing movably in the turning directions. An urging member may be interposed between the casing and the cap holder. The member urges the protective cap to either a first position where the cap is oriented opposite the direction in which the head holder can be moved toward the turning axis or a second position where the cap faces the ejection face of the print head when the head holder has been mounted on the carriage.

The urging member can alternatively orient the protective cap. Specifically, the cap is oriented to the first position while the head holder is moving toward the cap perpendicularly to the turning axis, and to the second position when this holder has turned around the axis. This enables the protective cap to follow the turning ejection face of the print head.

The casing of the capping mechanism and the cap holder may be connected by a link mechanism. The cap holder may include a protrusion formed on it. The capping mechanism may further include a limiter for engaging with the protrusion to limit the movement of the protrusion.

In accordance with a second aspect of the invention, another printer is provided, which includes a carriage movable in opposite reciprocating directions. The carriage has a turning axis extending in the reciprocating directions. A head holder can be mounted on the carriage, and holds a print head. The head has an ejection face and a nozzle for ejecting ink onto a printing medium. The nozzle is open in the ejection face. The printer also includes a capping mechanism, which includes a protective cap for covering the ejection face. The printer further includes a mounting device. This device includes a guide, a turning mechanism and a locking mechanism. The guide can guide the head holder in a direction inclined with respect to the mounting position until part of the head holder arrives at the turning axis. The turning mechanism enables the guided holder to turn around the axis to the mounting position. The locking mechanism can lock the head holder at the mounting position. The protective cap can move between a first position where the cap is oriented opposite the inclined direction and a second position where the cap faces the print head when the head holder is at the mounting position. The protective cap is supported in such a manner that, while it is moving from the first position to the second position, it is in close contact with the ejection face of the print head.

While the head holder of this printer is turning around the turning axis, the protective cap can move from the first position to the second position, kept in close contact with the ejection face of the print head. That is to say, while the cap is moving from the first position to the second position, it does not slide on the ejection face. This prevents the nozzle from clogging due to the cap slide.

In accordance with a third aspect of the invention, still another printer is provided, which includes a carriage movable in opposite reciprocating directions. The carriage has a turning axis extending in the reciprocating directions. A head holder can be mounted on the carriage, and holds a print head. The head has an ejection face and a nozzle for ejecting ink onto a printing medium. The nozzle is open in the ejection face. The printer also includes a capping mechanism, which includes a protective cap for covering the ejection face. The printer further includes a mounting mechanism, with which the head holder can be mounted on the carriage by a process including the steps of: moving the head holder toward the turning axis until part of the holder arrives at the axis; and thereafter turning the head holder around the axis.

The protective cap is supported in such a manner:

that, when the head holder is moved toward the turning axis, the ejection face of the print head comes into contact with an edge of the cap; and that, when the holder is turned around the axis, the ejection face and the cap come into close contact with each other without sliding on each other.

While the print head of this printer is replaced, the protective cap does not slide on the ejection face of the head. This prevents the nozzle from clogging.

In particular, the capping mechanism may be so designed that, while the head holder is turning around the turning axis, the edge of the cap and the line or the area on the ejection face which is in contact with the cap edge turn along the same locus.

The capping mechanism of this printer may further include a casing and a cap holder, which holds the protective cap. The cap holder is supported by the casing movably in the turning directions in which the head holder can turn. An urging member is interposed between the casing and the cap holder to urge the cap holder toward the print head. The casing, the cap holder and the urging member may be so designed that, while the head holder is turning around the turning axis, the edge of the cap and the line or the area on the ejection face which is in contact with the cap edge turn along the same locus.

The casing of this capping mechanism may include a back wall. The cap holder may include a pair of legs extending opposite the protective cap through the back wall. The legs are spaced in the turning directions, and may differ in length. The legs each have a stopper at the free end thereof for engaging with the back wall to limit the movement of the cap holder toward the print head.

The longer leg may be positioned on the leading side in the direction in which the head holder turns around the turning axis to be mounted on the carriage. The shorter leg may be positioned on the trailing side in this direction. In this case, the cap holder can move a longer distance on the leading side than on the trailing side.

The legs different in length and the urging member may be replaced with a pair of springs different in length as shown in FIG. 19A.

In accordance with a fourth aspect of the invention, yet another printer is provided, which includes a carriage. A head holder for holding a print head can be mounted on the carriage. The head has an ejection face and a nozzle for ejecting ink onto a printing medium. The nozzle is open in the ejection face. The printer also includes a capping mechanism, which includes a protective cap for covering the ejection face at a capping position where the cap faces the ejection face. The carriage can move in opposite reciprocating directions between a printing area where the carriage faces the printing medium and a capping area where the carriage faces the capping mechanism. The printer further includes a carriage controller for moving the carriage in the capping area to move the protective cap to a replacing position off the capping position when the head holder is to be mounted on the carriage.

When the print head of this printer is to be replaced, the controller moves the carriage in the capping area to move the protective cap to the replacing position which is offset from the capping position. The protective cap at the replacing position does not interfere with the ejection face of the print head while the head holder is mounted on the carriage.

The print head of this printer may comprise sub-heads arranged in the reciprocating directions. The protective cap may comprise sub-caps each associated with one of the sub-heads. The sub-heads may be displaced in the reciprocating directions from the sub-caps at the replacing position so that the sub-caps may not interfere with the sub-heads.

The carriage of this printer may have a turning axis extending in the reciprocating directions. The head holder may be mounted on the carriage by a process including the steps of: moving the head holder toward the turning axis until part of the holder arrives at the axis; and thereafter turning the holder around the axis.

In a conventional printer of this type, the head holder can be mounted on the carriage by such a process, with the protective caps kept at their capping position where they face the ejection faces of the print heads. While the head holder turns, the protective caps interfere with the ejection faces.

In accordance with the fourth aspect of the invention, the protective cap is at the replacing position offset from the capping position while the head holder is turning around the turning axis. The cap at the replacing position is out of contact with the ejection face while the head holder is turning.

The printer according to this aspect may further include a mounting mechanism with which the head holder can be mounted on the carriage. This mechanism may include a protrusion on at least one side of the head holder, a support in or on the carriage by which the protrusion can be supported rotatably, and a guide in or on the carriage for guiding the protrusion to the support.

This printer may further include a guide rod extending in the reciprocating directions. The carriage is supported slidably on the rod. The capping mechanism may further include a frame having a slope inclined with respect to the rod. The frame may support a guide shaft between the slope and the rod. The shaft extends in parallel with the rod. The protective cap may be supported by a casing, which is supported rotatably on and slidably along the shaft. The casing may include a first part for engaging with the carriage and a second part for sliding on the slope. In this case, when the carriage moves to the capping area, the carriage engages with the first part of the casing. This slides the second part on the slope to turn the casing around the shaft so that the cap approaches the ejection face. The invention is particularly effective for a printer including a capping mechanism of such structure.

While the protective cap of this printer is at the replacing position, the cap may be outside the locus described by the ejection face of the print head when the head holder turns around the turning axis. While the cap is at this position, the head holder can be mounted on the carriage. This keeps the ejection face of the head out of contact with the cap while the head holder is turning. In this case, the printer may further include a controller for controlling the movement of the carriage. This controller may control the position of the carriage in such a manner that, when the head holder is to be mounted on the carriage, the protective cap is off the capping position.

BRIEF DESCRIPTION OF THE DRAWINGS

Preferred embodiments of the invention will be described with reference to the accompanying drawings, in which.

DETAILED DESCRIPTION OF PREFERRED EMBODIMENTS

Figure 1:
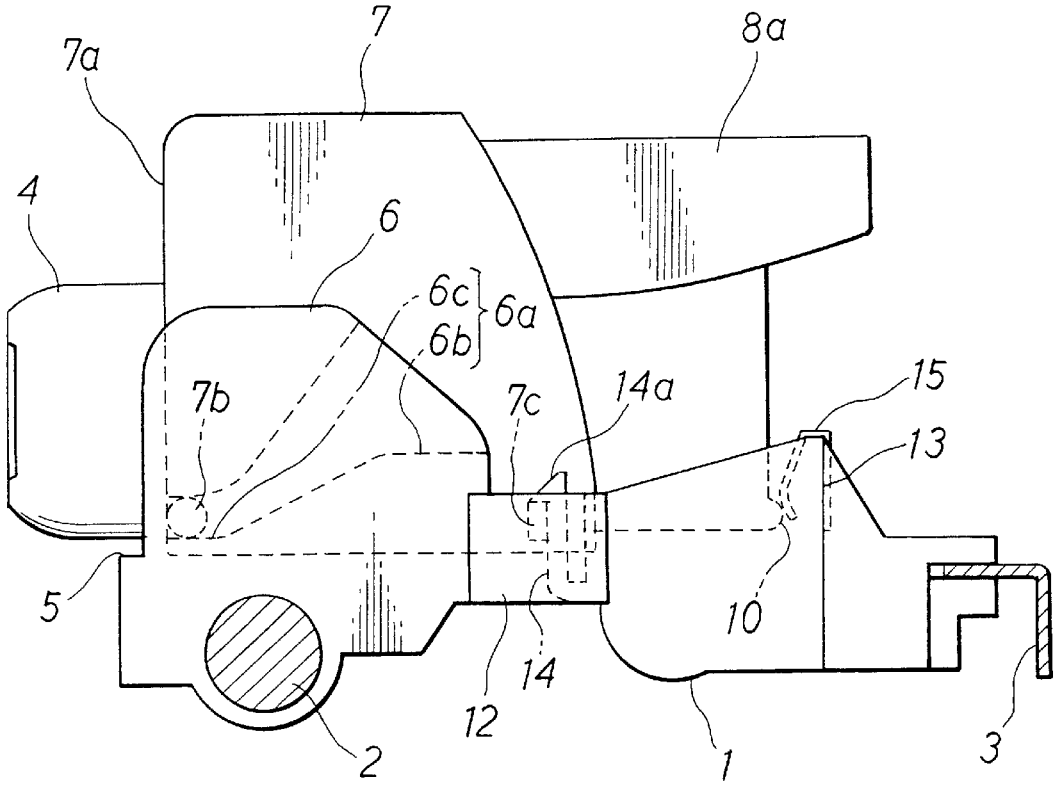
FIG. 1 is a side view of the carriage, a print head, an ink cartridge, etc. of an ink jet color printer according to a embodiment of the invention.

In the drawing figures for the embodiments of the invention, like parts are accorded the same reference numerals.

Figure 2:
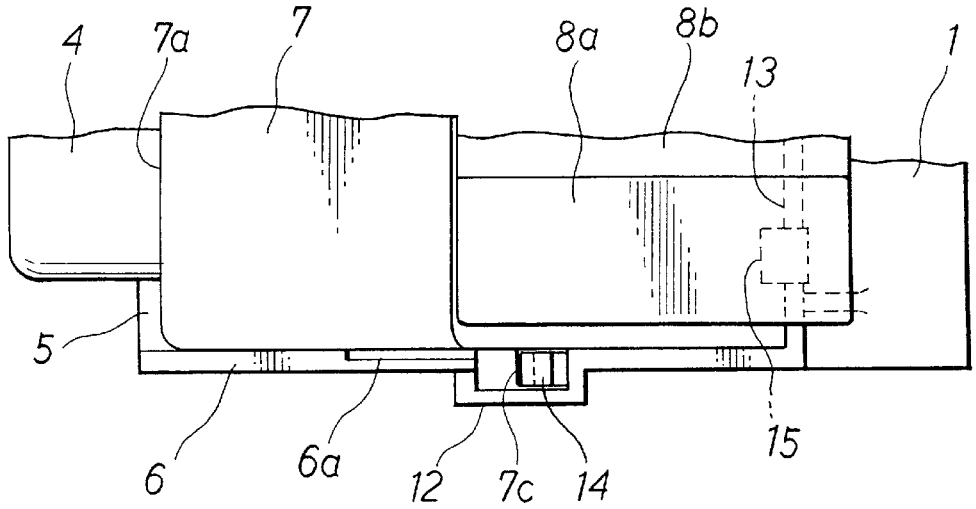
FIG. 2 is a fragmentary top view of parts of the printer according to the first embodiment.
Figure 8:
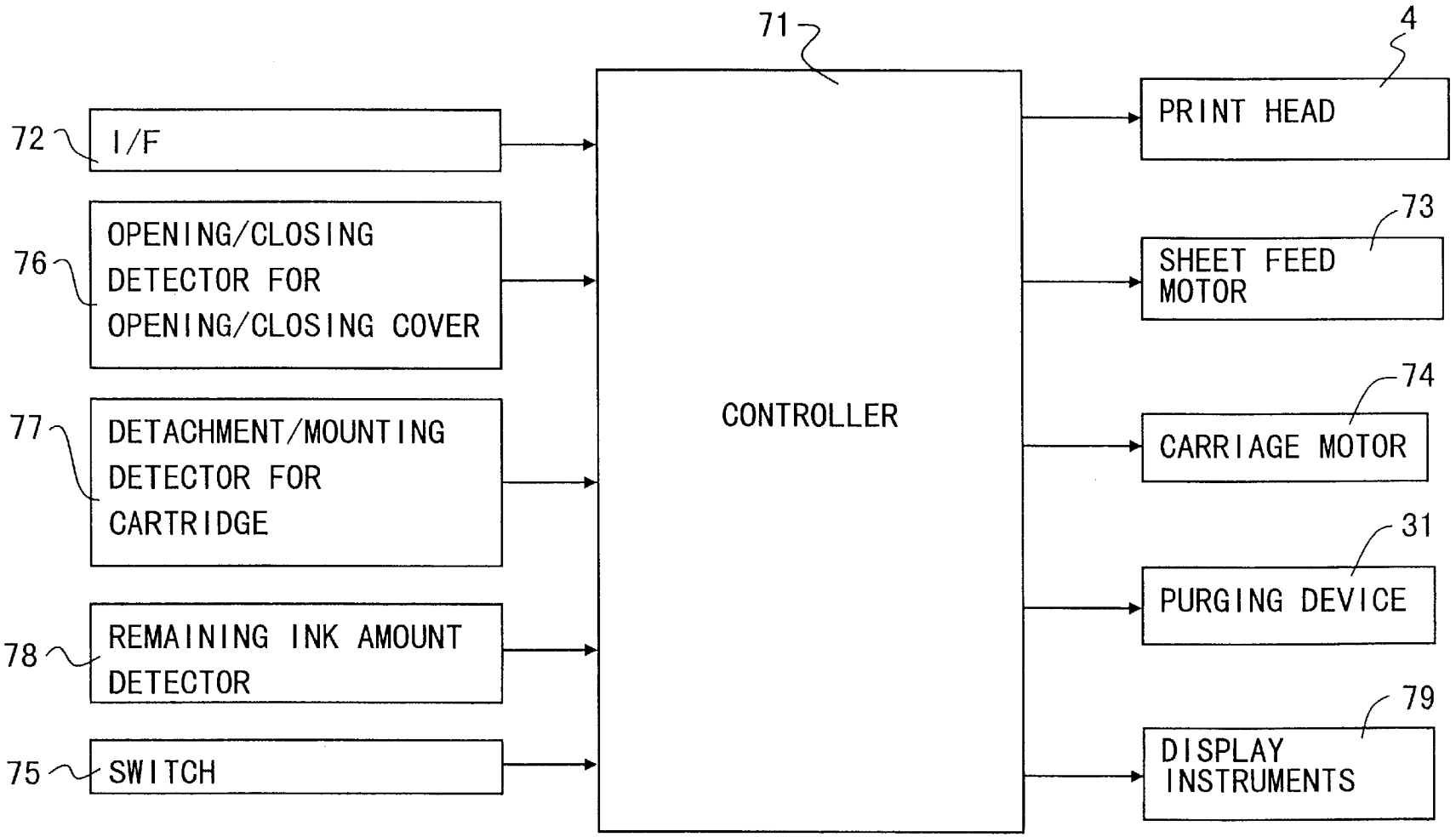
FIG. 8 is a block diagram of the control system of the printer according to the first embodiment.

With reference to FIG. 1, an ink jet color printer embodying the invention includes a guide rod 2 and a guide bar 3, which extend horizontally in parallel. A carriage 1 is supported slidably on the rod 2 and the bar 3, and can be reciprocated along them by a known driving means. The driving means includes a timing belt (not shown), which can be driven by a carriage motor 74 (FIG. 8). With reference to FIGS. 1 and 2, a head holder 7 can be mounted on the carriage 1. A head unit 4 is fixed to the front wall of the holder 7.

Figure 3:
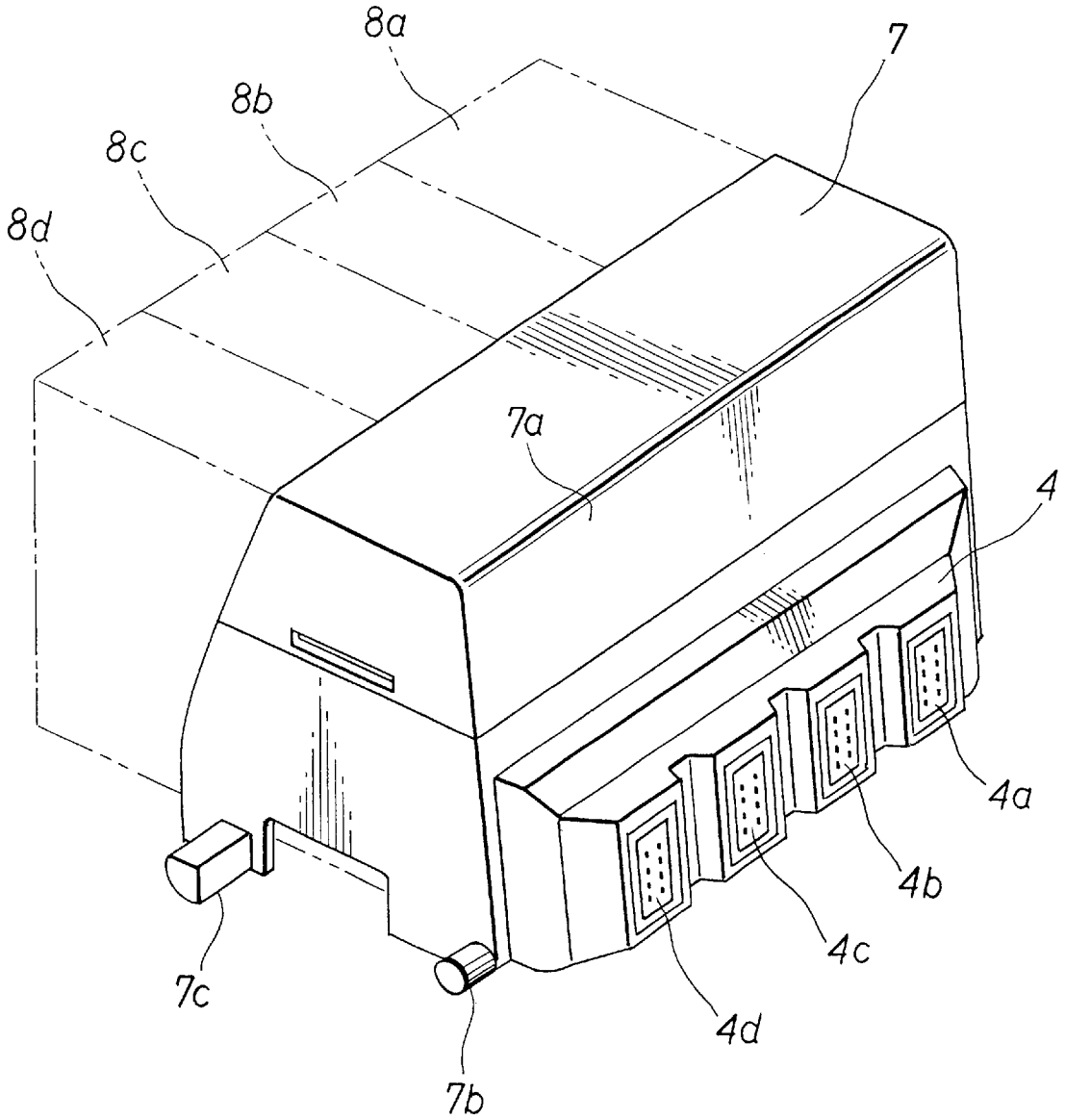
FIG. 3 is a perspective view of the head holder, the head unit and the ink cartridges of the printer according to the first embodiment.

As shown in FIG. 3, the head unit 4 includes four print heads 4*a*, 4*b*, 4*c* and 4*d* for different colors. Each of the heads 4*a*–4*d* has an ejection face and an array of nozzles formed in it. The front ends of the nozzles are open in the ejection face. The heads 4*a*–4*d* can be supplied with ink from four ink cartridges 8*a*, 8*b*, 8*c* and 8*d*, respectively. Printing paper (not shown) can be positioned substantially vertically in front of the head unit 4 and in parallel with the guide rod 2 and the guide bar 3. While the carriage 1 is sliding, with the head holder 7 mounted on it, ink can be ejected out through one or more of the nozzles onto the paper positioned in front of the head unit 4.

There may be cases where the head unit 4 needs replacing because of the lives, trouble, etc. of the print heads 4*a*–4*d*. The head unit 4 can be replaced when the carriage 1 has moved from the area where it faces the paper to the place where the heads 4*a*–4*d* are capped with four protective caps 22*a*, 22*b*, 22*c* and 22*d* (FIG. 6), respectively. The caps 22*a*–22*d* form part of a capping device 21.

With reference to FIGS. 1 and 2, the carriage 1 includes a rectangular base 5 extending substantially perpendicularly to the printing paper. A pair of side walls 6 stand in parallel on both sides of the base 5, and are positioned near its front end. The walls 6 define a space between them which is open at its front and rear ends. The head holder 7 and the ink cartridges 8*a*–8*d* can be mounted removably in this space.

A pair of middle side walls 12 stand on both sides of the carriage base 5, and are positioned midway between its front and rear ends. As shown in FIG. 2, each wall 12 includes an outer part parallel with the side walls 6 and a pair of end parts perpendicular to the outer part. The front end part of each wall 12 connects with the adjacent wall 6. A rear wall 13 stands on the rear end of the base 5 and substantially in parallel with the printing paper. The middle side walls 12 and the rear wall 13 are sufficiently lower than the side walls 6.

Figure 4:
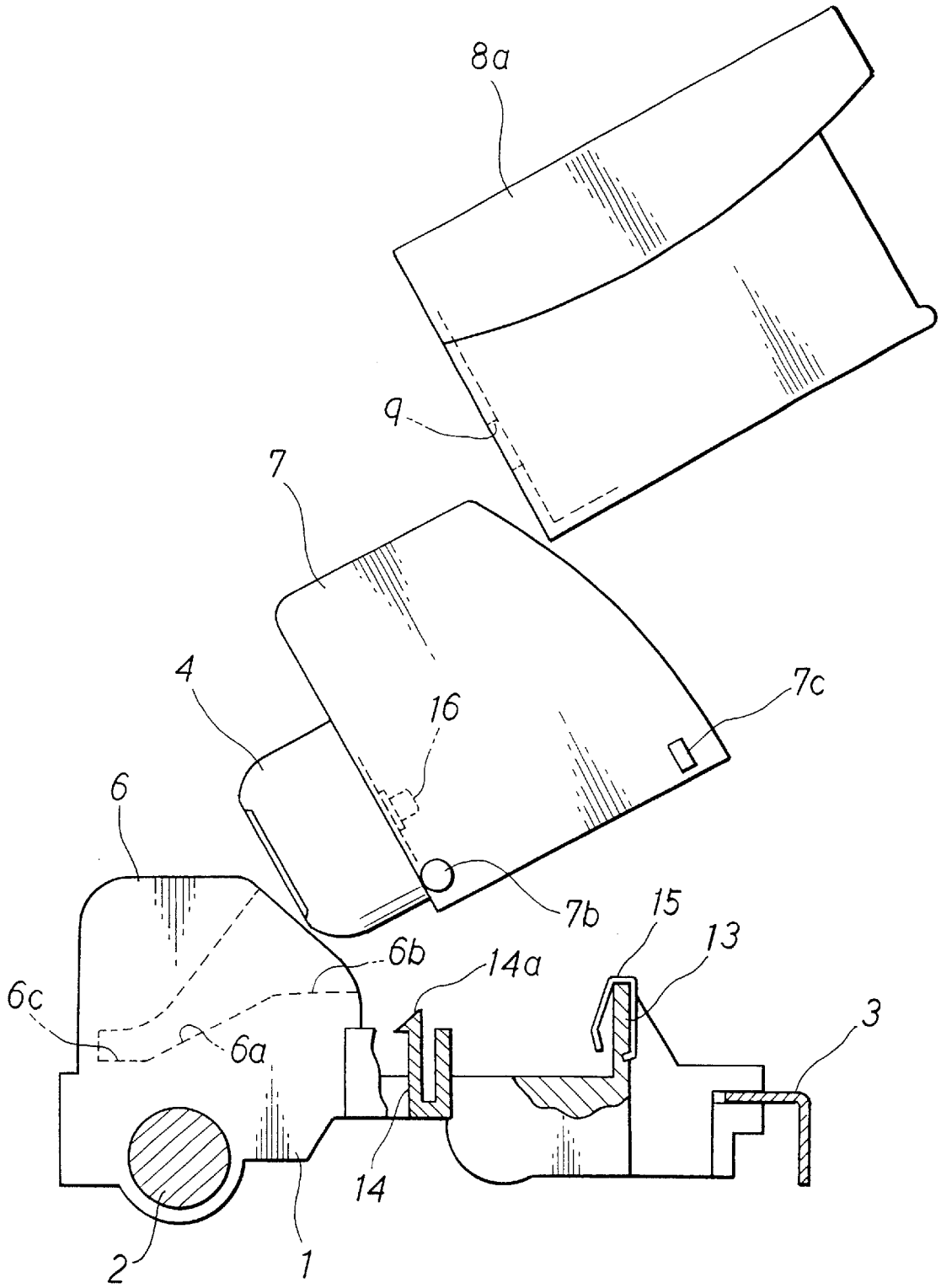
FIG. 4 is an exploded side view of the parts shown in FIG. 1.

The head holder 7 takes the form of a box open at its rear end. The head unit 4 is fixed to the front wall 7*a* of the holder 7 in such a manner that the ejection faces of the print heads 4*a*–4*d* face forward. As shown in FIG. 4, the front wall 7*a* has connectors 16 protruding backward, each of which connects with one of the heads 4*a*–4*d*. Each of the ink cartridges 8*a*–8*d* has an outlet hole 9 formed through its front wall to connect with the associated connector 16.

As shown in FIG. 3, the head holder 7 includes a pair of cylindrical or columnar pins 7*b* and a pair of square pins 7*c* all protruding horizontally from both its side walls. The cylindrical pins 7*b* are positioned near the front end of the bottom of the holder 7. The square pins 7*c* are positioned near the rear end of the bottom of the holder 7.

Each side wall 6 of the carriage 1 has a groove 6*a* formed on its inner side. The groove 6*a* is closed at its front end, widens backward and upward, and is open at its rear end. The groove 6*a* consists of a guide part 6*b* and a positioning part 6*c* in front of the guide part. The guide part 6*b* can guide the head holder 7 to the carriage 1 in a direction inclined with respect to the normal position of the holder 7, as shown in FIGS. 1 and 2, where the print heads 4*a*–4*d* face the printing position on the printing paper correctly. Each cylindrical pin 7*b* of the holder 7 can slide into the positioning part 6*c* of the adjacent or associated groove 6*a*. The grooves 6*a* in the walls 6 and the cylindrical pins 7*b* form means for mounting the holder 7 on the carriage 1.

Inside each middle side wall 12 of the carriage 1 is positioned an elastic hook 14, which extends in front of the rear end part of this wall uprightly from the bottom of this part. The hook 14 can bend forward and backward. The hook 14 is higher than the wall 12, and includes a pawl 14*a* formed at its top and inclined forward and downward. The hooks 14 inside the walls 12 and the square pins 7*c* of the head holder 7 form means for locking the holder 7 in position on the carriage 1.

The rear wall 13 of the carriage 1 is fitted with four plate springs 15. Each spring 15 includes an upper part inclined downward and forward, and a lower part inclined downward and backward. Each of the ink cartridges 8*a*–8*d* has a semi-spherical protrusion 10 formed at the bottom of its rear end to engage with one of the springs 15.

Thus, as shown in FIG. 4, the head holder 7 can be mounted forward and removably on the carriage 1. More specifically, the process of mounting the holder 7 includes:

engaging the cylindrical pins 7*b* of the holder 7 with the guide parts 6*b* of the grooves 6*a* in the side walls 6;

sliding the cylindrical pins 7*b* along the grooves 6*a* from the guide parts 6*b* to the positioning parts 6*c*; and turning the holder 7 around the cylindrical pins 7*b* at the front ends of the positioning parts 6*c* clockwise in FIG. 4 until the square pins 7*c* of the holder 7 slide or slip compressively on the hook pawls 14*a* and are locked by these pawls, which protrude on the turning loci of the pins 7*c*.

The head holder 7 mounted on the carriage 1 is stopped from moving forward by the engagement of the cylindrical pins 7*b* with the front ends of the positioning parts 6*c* of the wall grooves 6*a*. The mounted holder 7 is stopped from moving laterally relative to the carriage 1 by the contact of the side walls of the holder with the side walls 6 of the carriage. Otherwise, the holder 7 might be stopped from moving laterally by the contact of the cylindrical pins 7*b* with the bottoms of the grooves 6*a*. The front end of the mounted holder 7 is stopped from moving vertically by the engagement of the cylindrical pins 7*b* with the positioning parts of the grooves 6*a*. This brings the print heads 4*a*–4*d* to their normal position, where their ejection faces correctly face the printing position on the printing paper.

The rear end of the mounted holder 7 is stopped from moving vertically by the contact of the holder bottom with the carriage base 5 and the engagement of the square pins 7*c* of the holder with the hook pawls 14*a*. The mounted holder 7 is restrained from moving backward by the engagement of the square pins 7*c* with the hooks 14. This locks the holder 7, with the print heads 4*a*–4*d* at the normal position. The hooks 14 may urge the square pins 7*c* forward. Otherwise, the hooks 14 may be spaced slightly from the pins 7*c*. In this case, the rear end of the holder 7 is positioned by the plate springs 15 pressing the ink cartridges 8*a*–8*d*.

Figure 10:
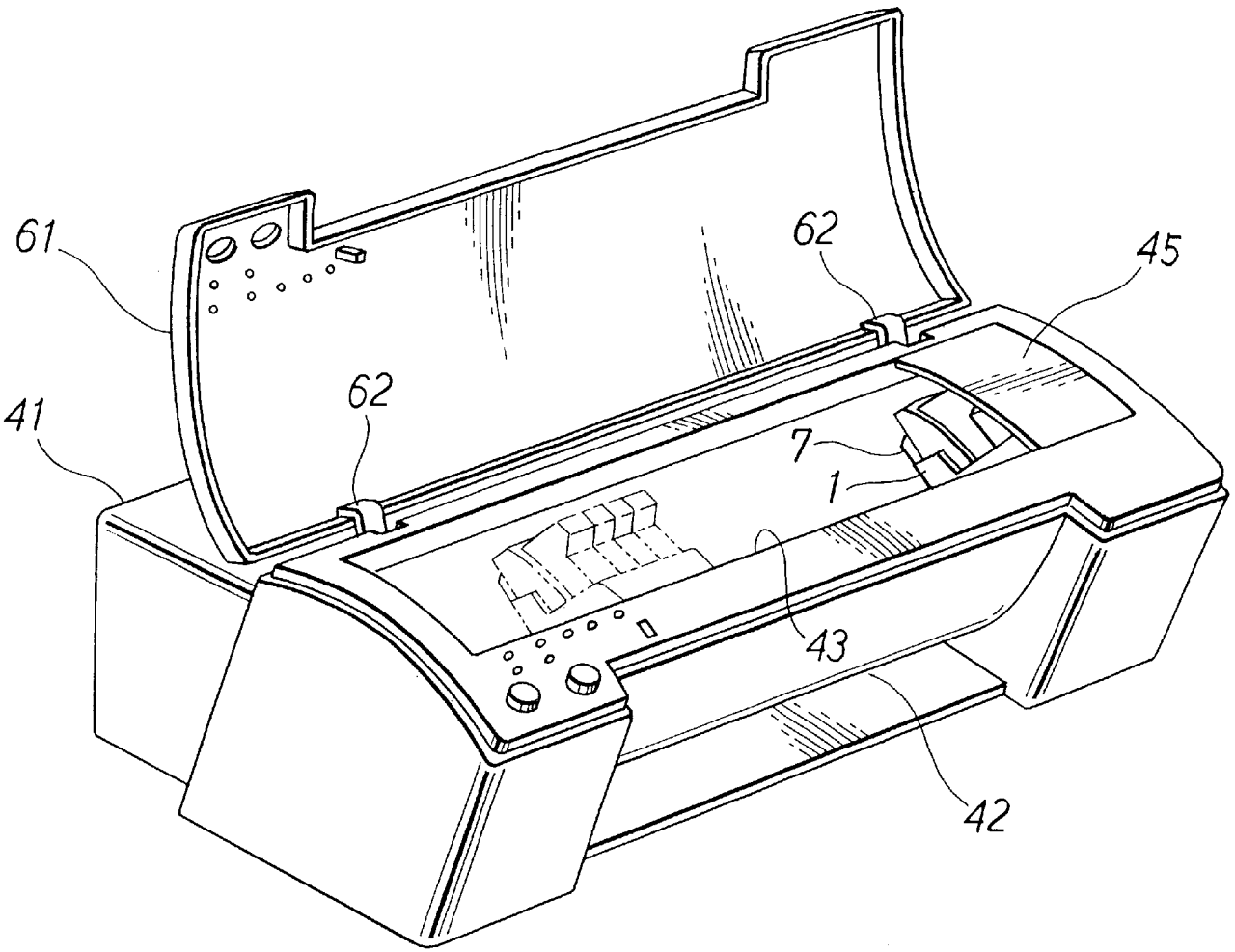
FIG. 10 is a perspective view of the printer according to the first embodiment, the outer cover of which is open.

With reference to FIG. 10, the printer includes an outer casing 41, which has a top opening 43. Back to FIG. 1, the head holder 1 and the wall grooves 6*a* are open backward from the print heads 4*a*–4*d* and toward the top opening 43. The ink cartridges 8*a*–8*d* and the head holder 7 can be mounted on the carriage 1 removably through this opening 43.

It is possible to remove the head holder 7 from the carriage 1 by pushing the hook pawls 14*a* backward to disengage them from the square pins 7*c*, then turning the rear end of the holder 7 upward, and thereafter pulling the holder 7 backward to disengage the cylindrical pins 7*b* from the wall grooves 6*a*.

It is possible to mount the ink cartridges 8*a*–8*d* by inserting them into the head holder 7 to engage their outlet holes 9 with its connectors 16, and then pushing the rear ends of the cartridges 8*a*–8*d* down against the elasticity of the plate springs 15 with the semi-spherical protrusions 10 sliding along the springs. The springs 15 urge the cartridges 8*a*–8*d* forward to keep them connected with the print heads 4*a*–4*d*.

It is possible to remove the ink cartridges 8*a*–8*d* by lifting their rear ends to disengage their protrusions 10 from the plate springs 15, and then pulling the cartridges out of the head holder 7. While the cartridges 8*a*–8*d* are thus removed, the holder 7 is mounted on the carriage 1.

The cylindrical pins 7*b* might be formed on the side walls 6 of the carriage 1. The grooves 6*a* might be formed in the side walls of the head holder 7.

Figure 5:
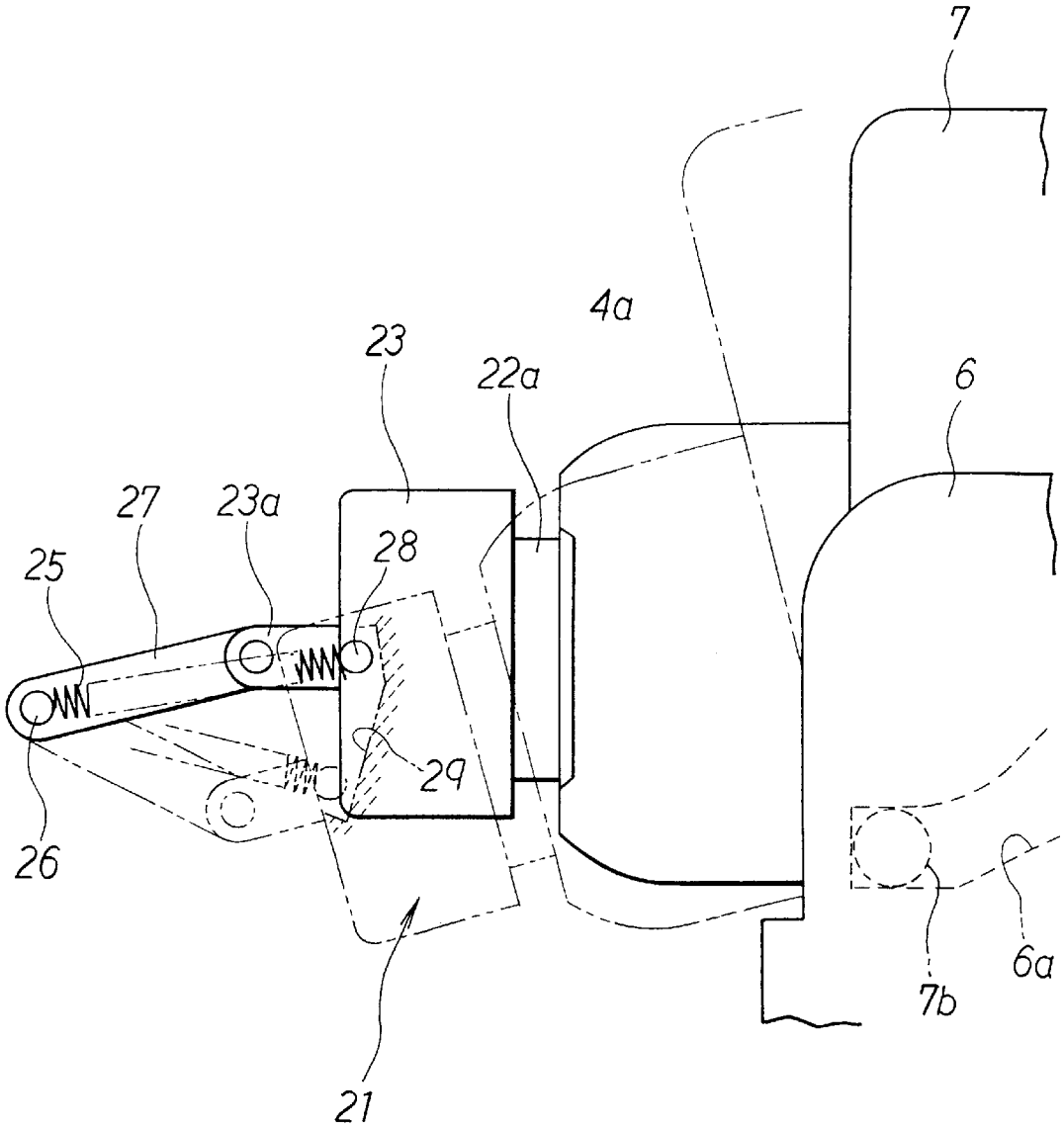
FIG. 5 is a schematic side view of the capping device etc. of the printer according to the first embodiment.
Figure 6:
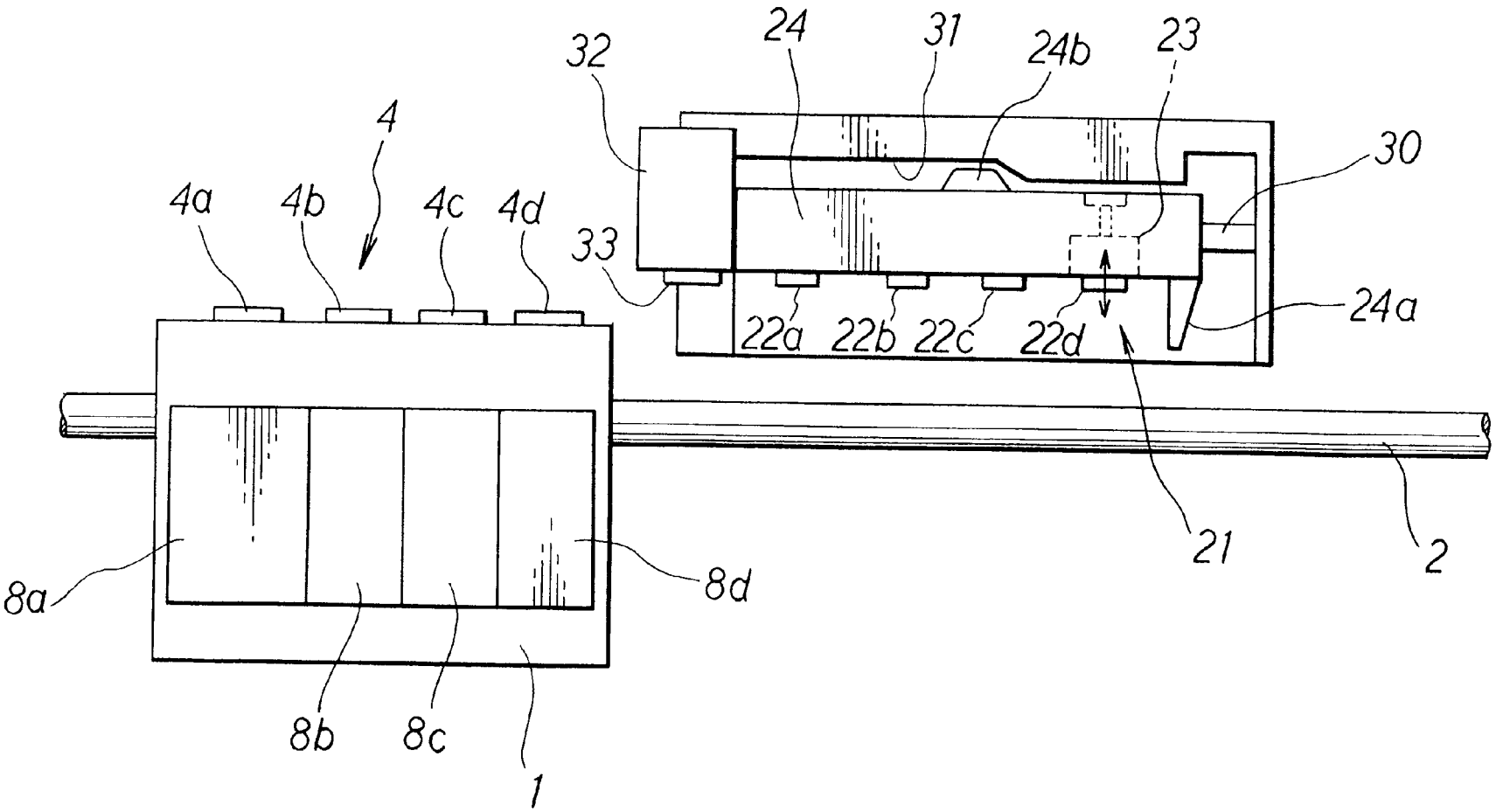
FIG. 6 is a schematic top view of the capping device, the carriage, etc. of the printer according to the first embodiment.

With reference to FIGS. 5 and 6, the capping device 21 is positioned outside one edge of the path along which the paper moves. The carriage 1 can move to its end position in front of the capping device 21. The protective caps 22*a*–22*d* of the device 21 can closely cover the ejection faces of the print heads 4*a*–4*d*, respectively, to prevent the ink in the head nozzles from drying. The caps 22*a*–22*d* are each supported by a cap holder 23. The cap holders 23 for the four caps are supported by a casing 24, each through a connecting link 25, movably in the directions in which the head holder 7 turns. Each of the caps 22*a*–22*d* is urged by a compression spring 27 to a position where the cap faces the associated print head 4*a*, 4*b*, 4*c* or 4*d* inclined as shown with two-dot chain lines in FIG. 5 or, alternatively, the position where the cap faces the head at its normal position shown with solid lines in FIG. 5.

Each cap holder 23 has an arm 23*a* extending from its rear wall. Each connecting link 25 is connected pivotably at one end to the associated arm 23*a* and at the other end through a horizontal pin 26 to the casing 24 of the capping device 21. Each cap holder 23 also has a horizontal pin 28 extending from one of its side walls. Each compression spring 27 is interposed between the associated pins 28 and 26 to urge the associated protective cap 22*a*, 22*b*, 22*c* or 22*d* toward the associated print head 4*a*, 4*b*, 4*c* or 4*d*. The casing 24 has a stopper 29, with which the holder pins 28 can engage to limit the movement of the caps 22*a*–22*d* to the range between the cap positions shown with solid lines and two-dot chain lines in FIG. 5.

The urging force of each compression spring 27 is such that, when the head holder 7 turns around the cylindrical pins 7*b*, with the associated protective cap 22*a*, 22*b*, 22*c* or 22*d* in close contact with the associated print head 4*a*, 4*b*, 4*c* or 4*d*, the cap follows the head. This movement of the caps 22*a*–22*d* is guided by the connecting links 25.

As shown in FIG. 6, the capping device 21 includes a horizontal guide rod 30. The bottom of the casing 24 of this device is supported rotatably on and slidably along the rod 30. The casing 24 has an arm 24*a* extending from its bottom into the path along which the carriage 1 reciprocates. The casing 24 also has a protrusion 24*b* formed on its rear wall and positioned near its top. The capping device 21 also includes an inclined cam 31 for engagement with the protrusion 24*b*. The casing 24 is urged by one or more springs (not shown) counterclockwise in FIG. 5 around the rod 30 and to the left in FIG. 6 to be positioned as shown in FIG. 6.

Figure 7A:
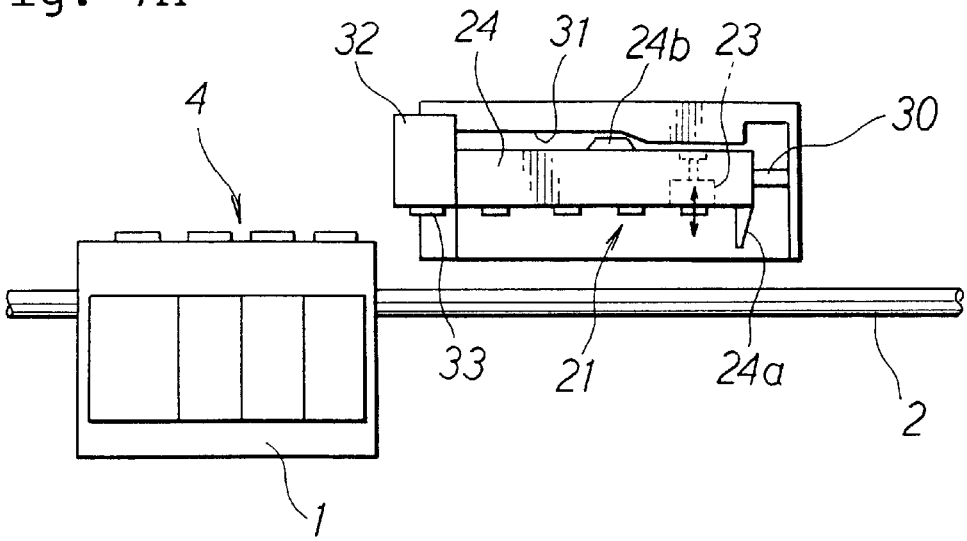
FIGS. 7A, 7B and 7C are views similar to FIG. 6, but showing the operation of the capping device.
Figure 7B:
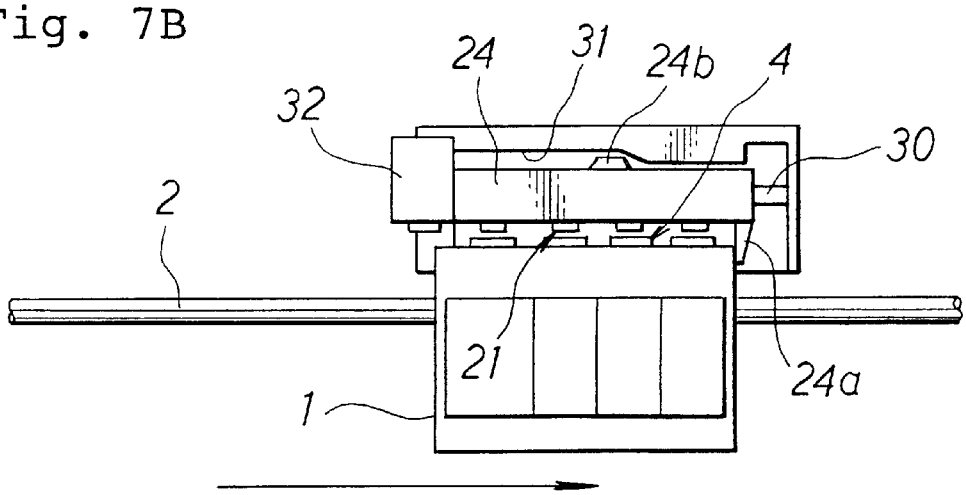
Figure 7C:
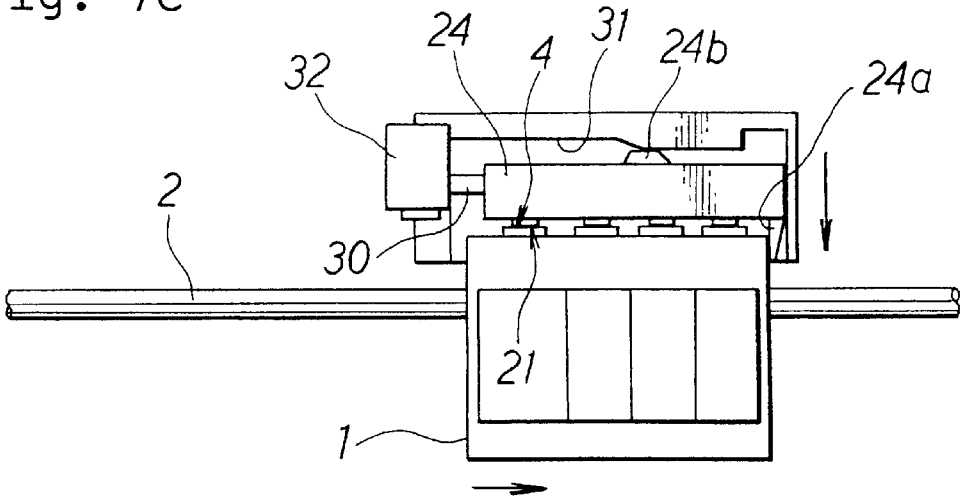

When, as shown in FIGS. 7B and 7C, the carriage 1 moves beyond the printing area to the right in these figures, it comes into contact with the arm 24*a*. As shown in FIG. 7C, further movement of the carriage 1 slides the casing 24 together along the guide rod 30, with the protrusion 24*b* slid along the inclined cam 31. This movement turns the casing 24 around the rod 30 to move the protective caps 22*a*–22*d* toward the print heads 4*a*–4*d*. This causes the caps 22*a*–22*d* to cover the ejection faces of the heads 4*a*–4*d*. When the carriage 1 returns to the printing area, the casing 24 returns to its initial position shown in FIGS. 7A and 7B.

As shown in FIGS. 6 and 7A–7C, a purging device 32 is positioned near the capping device 21. The purging device 32 includes a suction cap 33, which can be moved toward and away from the head unit 4 by a driving means (not shown). The cap 33 can closely cover the ejection face of one of the print heads 4*a*–4*d* selectively. A suction pump (not shown) can develop negative pressure for sucking ink from the nozzles of the head capped with the cap 33.

With reference to FIG. 8, the printer includes a controller 71, which includes a CPU, a ROM, a RAM and hardware logic circuits. The printer also includes a sheet feed motor 73 as the motive power source for feeding printing paper. The controller 71 receives data through an interface 72. On the basis of the received data, the controller 71 controls the print heads 4*a*–4*d* and the motors 73 and 74 to execute a printing operation. The controller 71 receives signals from switches 75, a cover detector 76 for determining whether the outer cover described below is open or closed, cartridge detectors 77 each fitted to the carriage 1 to determine whether one of the ink cartridges 8*a*–8*d* is mounted or removed, and ink detectors 78 each for detecting the amount of ink remaining in one of the cartridges. In accordance with the received signals, the controller 71 controls the printing operation, the purging device 31 and indicators (DISPLAY INSTRUCTION) 79.

While no printing is carried out, the controller 71 stops the carriage 1 at the capping position, as shown in FIG. 7C, where the protective caps 22*a*–22*d* cover the ejection faces of the print heads 4*a*–4*d*.

Figure 9A:
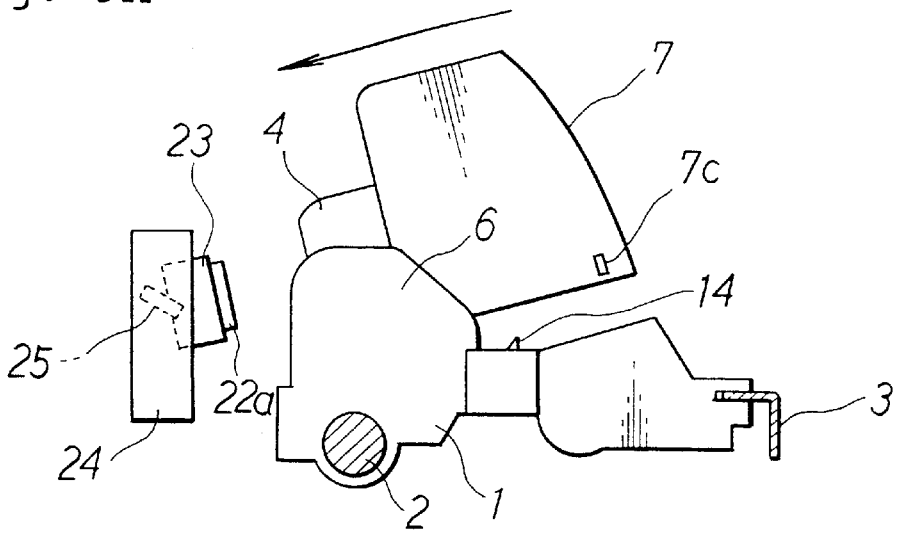
FIGS. 9A, 9B and 9C are side views of the capping device, the carriage, etc. of the printer according to the first embodiment, showing the operation of this device.
Figure 9B:
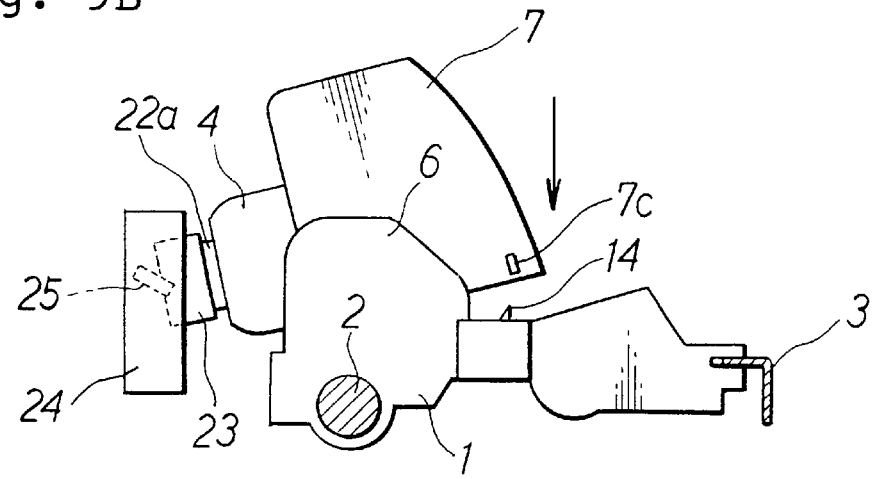
Figure 9C:
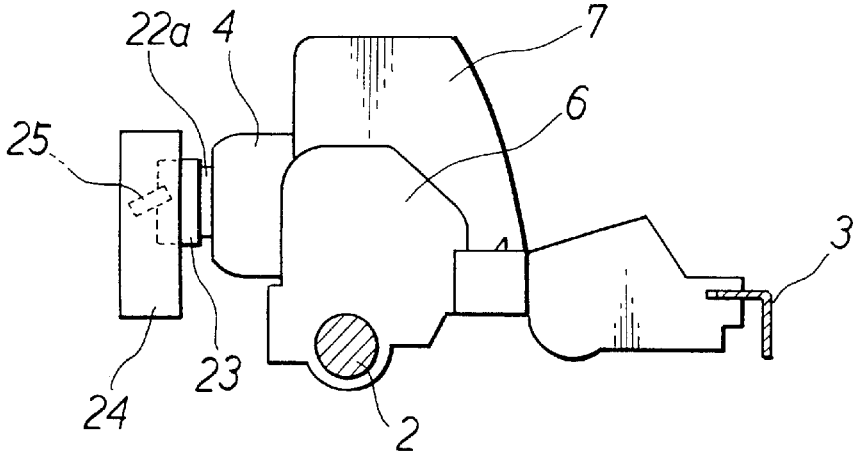

FIG. 9C shows the protective caps 22*a*–22*d* capping the print heads 4*a*–4*d*. When, as shown in FIG. 9B, the head holder 7 is turned around the cylindrical pins 7*b* counterclockwise in this figure from the position shown in FIG. 9C, the caps 22*a*–22*d* follow the heads 4*a*–4*d*, inclining upward.

Then, as shown in FIG. 9A, the head holder 7 can be removed from the carriage 1. Even after the holder 7 is removed, the compression springs 27 keep the caps 22*a*–22*d* inclined upward.

As shown in FIG. 9A, a new head holder 7 with a new head unit 4 can be mounted on the carriage 1 in the foregoing way, with its cylindrical pins 7*b* guided along the wall grooves 6*a*. When the pins 7*b* reach the positioning parts 6*c* of the grooves 6*a*, as shown in FIG. 9B, the whole or entire ejection faces of the print heads 4*a*–4*d* come into contact with the protective caps 22*a*–22*d*, which are inclined upward. When the holder 7 is then turned around the pins 7*b* clockwise in FIG. 9B to be locked, as stated above, the caps 22*a*–22*d* follow the heads 4*a*–4*d*, kept in contact with the whole ejection faces. When the holder 7 is locked to the carriage 1, as shown in FIG. 9C, the caps 22*a*–22*d* have moved to their position where they cap the heads 4*a*–4*d* in position. Thus, the ejection faces of the heads 4*a*–4*d* and the caps 22*a*–22*d* do not rub mutually or relatively.

Figure 11:
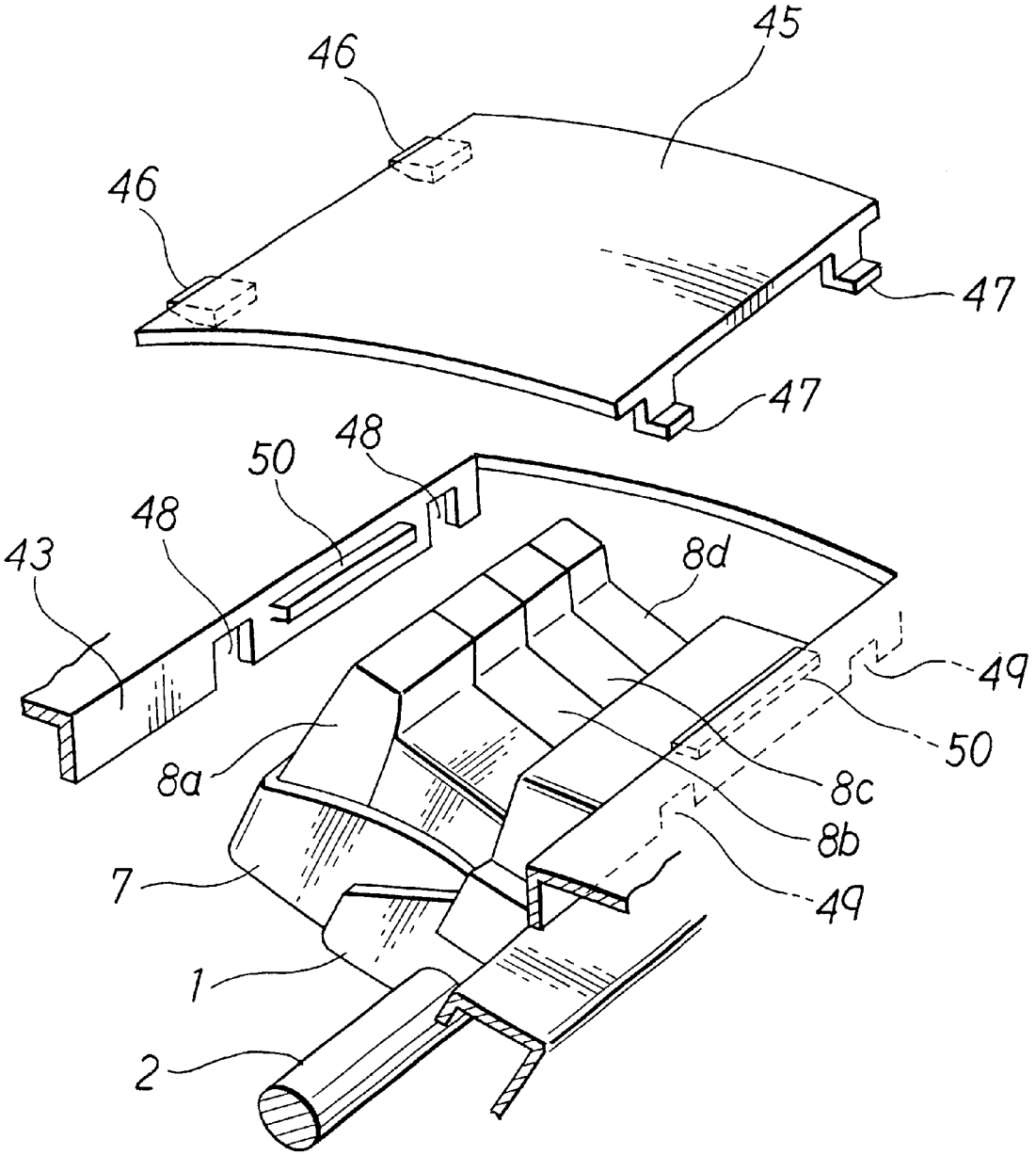
FIG. 11 is a fragmentary perspective view of the printer according to the first embodiment, the inner cover of which is removed.

For convenience, the ejection faces of the print heads 4*a*–4*d* have been described as positioned vertically. As shown in FIGS. 10 and 11, however, the printer casing 41 houses the carriage 1 etc. in such a manner that the ejection faces of the heads 4*a*–4*d* incline downward. This casing 41 has a discharge port 42 formed in its front to discharge printed paper. The top opening 43 of the casing 41 is positioned substantially over the heads 4*a*–4*d* and the ink cartridges 8*a*–8*d*, and extends in the directions in which the carriage 1 reciprocates. The opening 43 extends over the printing area and an area in front of the capping device 21.

An inner cover 45 is fitted removably to the top opening 43, and positioned over the area in front of the capping device 21. As shown in FIG. 11, this cover 45 has a pair of nails 46 formed on its rear end and a pair of hooks 47 formed on its front end. The printer casing 41 has two pairs of recesses 48 and 49 formed at the rear and front edges, respectively, of the top opening 43. The casing 41 also has a pair of protrusions 50 formed at these edges of the opening 43. One of the protrusions 50 is positioned between the recesses 48, and the other between the recesses 49.

It is possible to fit the inner cover 45 to the casing 41 by first engaging the nails 46 with the recesses 48, and then engaging the hooks 47 with the other recesses 49 by taking advantage of the elasticity of the cover 45 and the casing 41. The protrusions 50 stop the cover 45 from falling into the casing 41. While the printer is in normal use, the head unit 4 may be positioned in front of the capping device 21 (for example, when printing is halted). In this case, the cover 45 covers the print heads 4*a*–4*d*, the ink cartridges 8*a*–8*d* and the carriage 1 to prevent hands from touching them accidentally.

As explained in connection with the related art, the head unit 4 can be replaced when the print heads 4*a*–4*d* are positioned opposite the protective caps 22*a*–22*d* while printing is halted. While the head unit 4 is replaced, the inner cover 45 is removed.

As shown in FIG. 10, the outer cover 61 is connected to the top of the printer casing 41 by hinges 62, and can cover the inner cover 45 and the top opening 43.

FIGS. 12A–12C, 13 and 14A–14C show the capping device 21 etc. of an ink jet color printer according to another embodiment of the invention. This printer includes print heads 4*a*–4*d* and a carriage 1, which are identical with those of the foregoing printer. The descriptions of these parts will not be repeated. The capping device 21 is positioned outside one edge of the path along which printing paper moves.

Figure 12A:
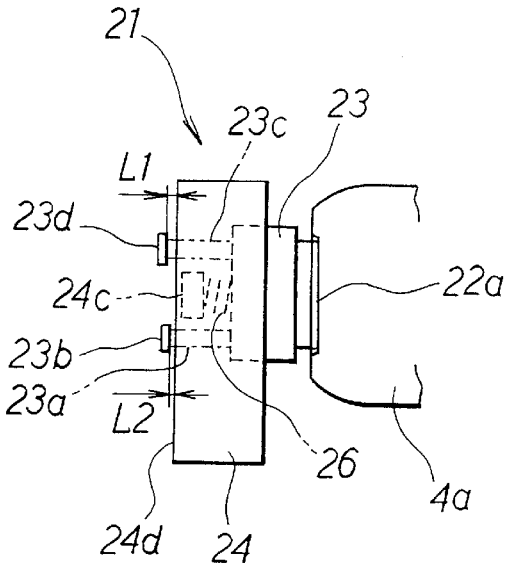
FIG. 12A is a side view of the capping device etc. of an ink jet color printer according to a second embodiment of the invention.

With reference to FIG. 12A, the capping device 21 includes four protective caps 22*a*, 22*b*, 22*c* and 22*d* (only 22*a* shown) for closely capping the ejection faces of the print heads 4*a*–4*d*, respectively. This capping function is similar to that of the previous embodiment. The caps 22*a*–22*d* are each held by a cap holder 23. The capping device 21 also includes a casing 24, which includes a front wall adjacent to the print heads 4*a*–4*d* and a rear wall 24*d*.

Figure 12B:
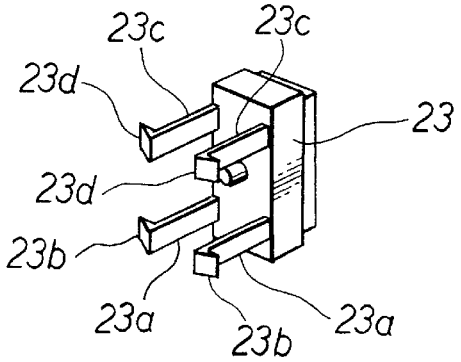
FIG. 12B is a perspective view of a cap holder of the capping device shown in FIG. 12A.
Figure 12C:
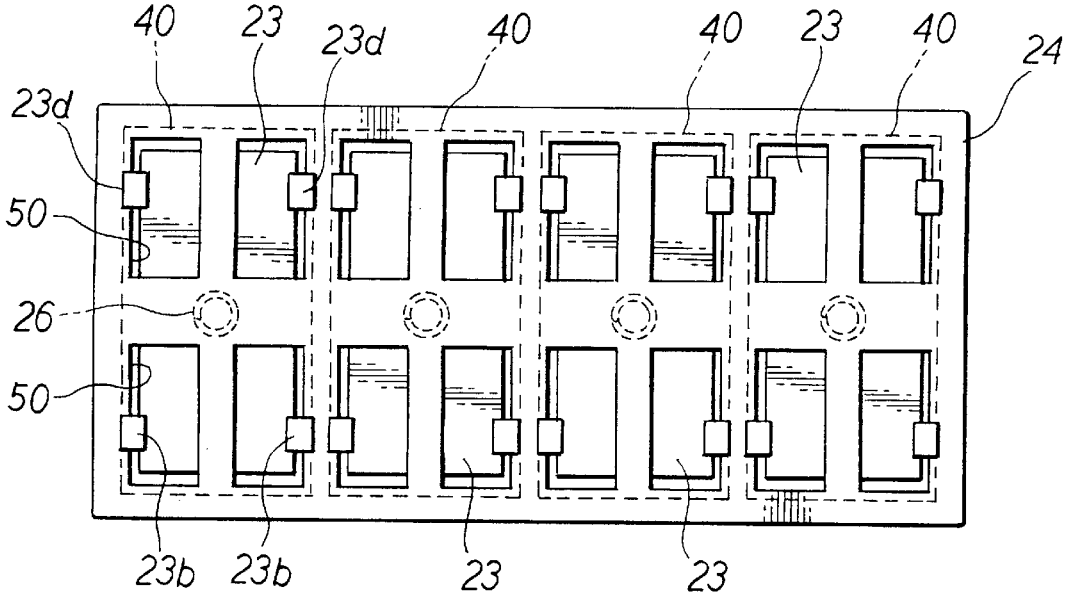
FIG. 12C is a back view of the casing of the capping device shown in FIG. 12A.

As shown with dotted lines in FIG. 12C, the front wall of the casing 24 has four holes 40 formed through it, which are sufficiently larger than the cap holders 23 for the four caps. Each cap holder 23 is positioned in one of the holes 40. The cap holder 23 can move in the directions in which the head holder 7 turns, and toward and away from this holder 7. The rear wall 24*d* has four sets of four holes 50 formed through it. Each set of holes 50 are positioned in the rear of one of the front holes 40.

The rear wall 24*d* of the casing 24 has four spring shoes 24*c* each formed on its inner side and surrounded by one set of holes 50. A compression spring 26 is interposed between each cap holder 23 and the adjacent shoe 24*c* to urge the associated cap toward the heads 4*a*–4*d*.

As best shown in FIG. 12B, each cap holder 23 has four legs 23*c* and 23*a* extending from its rear. The upper legs 23*c* are longer than the lower legs 23*a*. Each of the leg 23*c* and 23*a* extends through one of the rear holes 50. The upper and lower legs 23*c* and 23*a* have claws or stoppers 23*d* and 23*b* on their respective rear ends. The claws 23*d* and 23*b* can engage with the rear wall 24*b* to stop the cap holder 23 from moving beyond a predetermined position toward the head holder 7. The claws 23*d* and 23*b* can move within allowable lengths L1 and L2, respectively, between the rear wall 24*d* and the stoppers. The length L1 is greater than the length L2.

As stated later, the urging force of each compression spring 26 is such that, when the head holder 7 turns around the cylindrical pins 7*b*, with the upper edge of the associated protective cap 22*a*, 22*b*, 22*c* or 22*d* in contact with the associated print head 4*a*, 4*b*, 4*c* or 4*d*, the cap follows the head.

Figure 13:
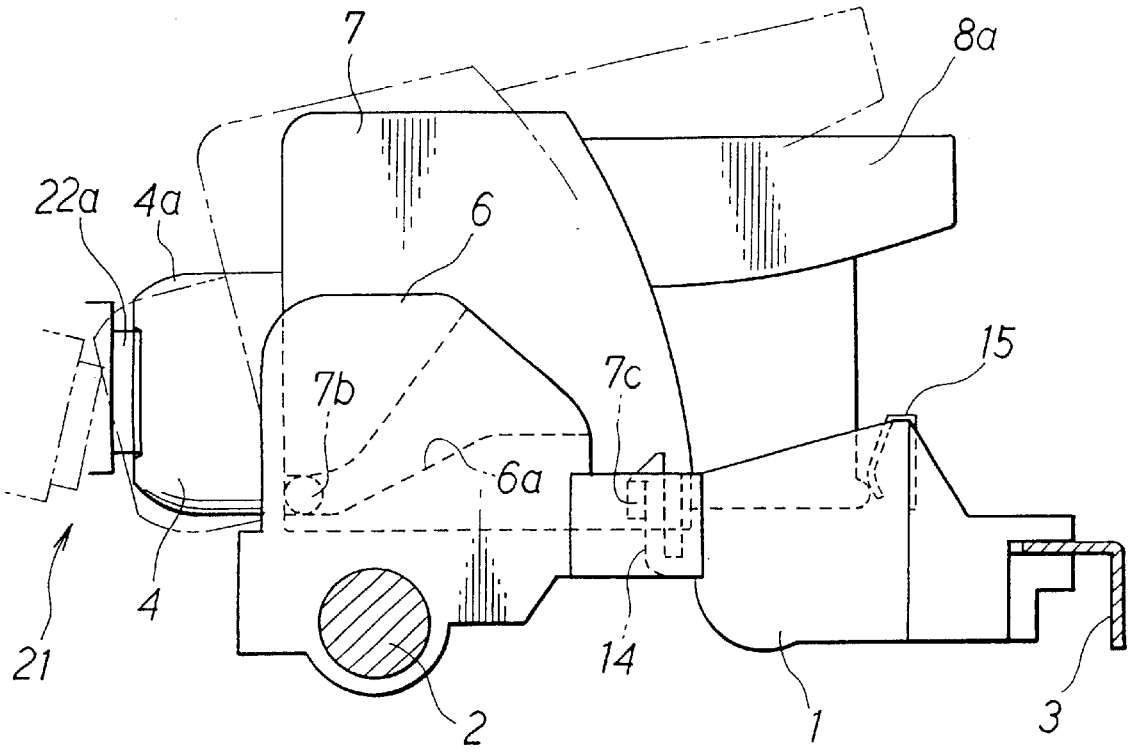
FIG. 13 is a side view of the carriage, a print head, an ink cartridge, etc. of the printer according to the second embodiment.

The compression springs 26 urge the cap holders 23 in such a manner that, as shown with two-dot chain lines in FIG. 13, the upper edges of the protective caps 22*a*–22*d* are positioned nearer to the print heads 4*a*–4*d* than the lower edges of the caps. When the head holder 7 is put on the carriage 1 in a direction inclined with respect to the normal position of this holder, as shown with two-dot chain lines in FIG. 13, with the caps 22*a*–22*d* inclined as also shown, the upper edges of the ejection faces of the heads 4*a*–4*d* come into contact with the upper edges of the caps. As stated later, the position where the upper edges of the ejection faces come into contact with the upper edges of the caps is such that, when the head holder 7 has turned to its normal position, with the caps following the heads, the caps can cover the ejection faces.

When the head holder 7 is turned from its inclined position around the cylindrical pins 7*b* clockwise in FIG. 13 to be locked to the carriage 1, the protective caps 22*a*–22*d* are moved up, turning or inclining around their upper edges, by following the print heads 4*a*–4*d*. When the head holder 7 is mounted in position on the carriage 1, as shown with solid lines in FIG. 13, the caps 22*a*–22*d* cover the ejection faces of the heads 4*a*–4*d* closely. Thus, the caps 22*a*–22*d* do not rub on the ejection faces of the heads 4*a*–4*d* while the caps are moving from their lower position where their upper edges are in contact with the heads to their upper position where they closely cap the heads in position.

As is the case with the previous embodiment, the head unit 4 can be replaced when the carriage 1 is positioned in the area where the protective caps 22*a*–22*d* are opposite the print heads 4*a*–4*d*. If the head holder 7 is removed in the foregoing way when the print heads 4*a*–4*d* are in close contact with the caps 22*a*–22*d*, as shown in FIG. 14C, the caps are inclined downward by the force of the compression springs 26, as shown in FIG. 14A.

Figure 14A:
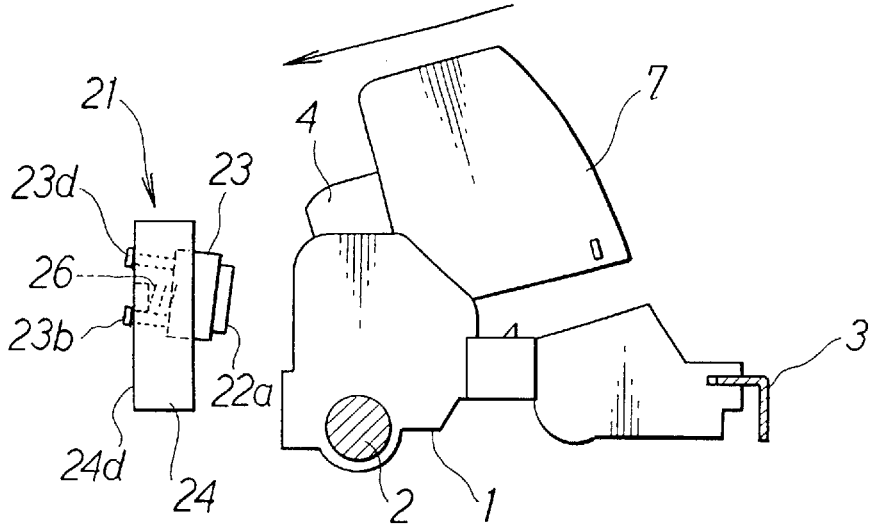
FIGS. 14A, 14B and 14C are side views of the capping device, the carriage, etc. of the printer according to the second embodiment, showing the operation of this device.
Figure 14B:
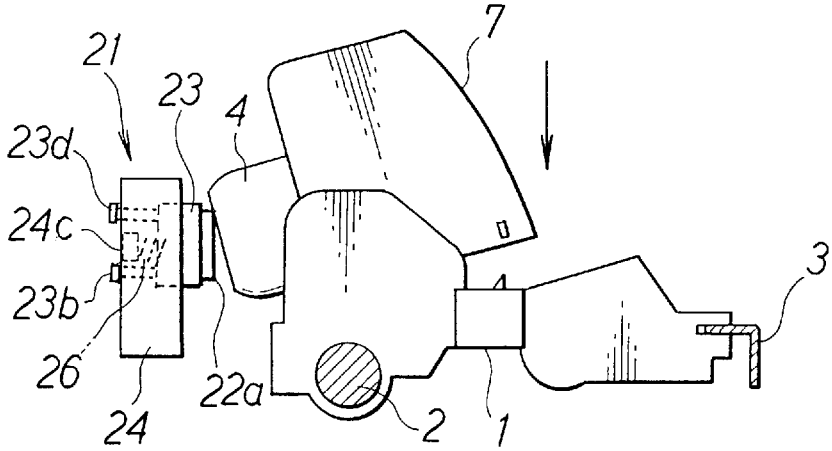
Figure 14C:
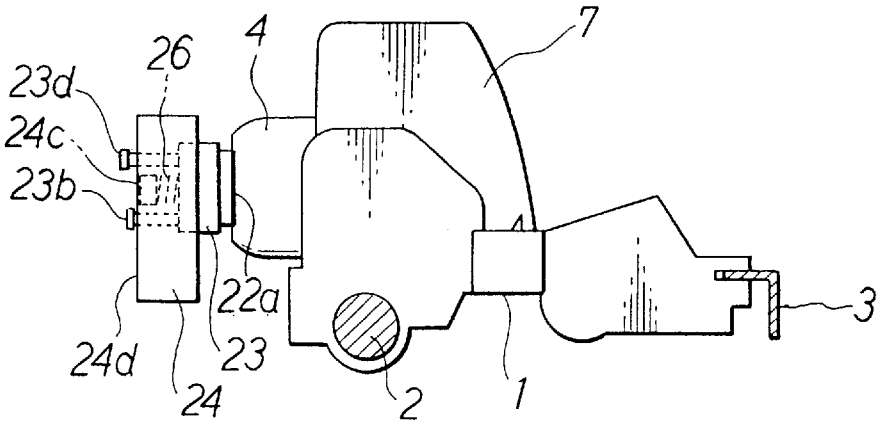

As shown in FIG. 14A, a new head holder 7 with a new head unit 4 can be mounted on the carriage 1, with its cylindrical pins 7*b* guided along the wall grooves 6*a*, as stated above. When the pins 7*b* reach the positioning parts 6*c* of the grooves 6*a*, the upper edges of the ejection faces of the print heads 4*a*–4*d* come into contact with the upper edges of the downwardly inclined protective caps 22*a*–22*d*, as shown in FIG. 14B. When the holder 7 is then turned around the pins 7*b* clockwise in FIG. 14B to be locked, the caps 22*a*–22*d* turn in such a manner that their lower edges approach the lower edges of the ejection faces, with their upper edges kept in contact with the upper edges of the ejection faces. In other words, when the head holder 7 is mounted on the carriage 1, the upper edges of the ejection faces of the print heads 4*a*–4*d* come into contact first with the upper edges of the protective caps 22*a*–22*d*. The upper edges of the caps 22*a*–22*d* are not displaced from the upper edges of the ejection faces even while the holder 7 is turning as shown in FIGS. 14B and 14C. Thus, the ejection faces of the heads 4*a*–4*d* and the caps 22*a*–22*d* do not rub mutually or relatively.

In each of the foregoing embodiments, it is preferable that the protective caps 22*a*–22*d* do not rub at all on the ejection faces of the print heads 4*a*–4*d*. However, it does not depart from the spirit of the invention that, with each of the caps 22*a*–22*d* covering all the nozzles of the associated head 4*a*, 4*b*, 4*c* or 4*d*, the periphery of the cap rubs on the ejection face slightly without crossing the nozzles, because this does not force dust or the like into the nozzles.

In each of the foregoing embodiments, the head unit 4 can be replaced at not only its position where the ejection faces of the print heads 4*a*–4*d* are in complete contact with the protective caps 22*a*–22*d*, but also its position where the heads are followed by the caps while the head holder 7 is turned.

FIGS. 15, 16 and 17A–17C show the capping device 21 etc. of an ink jet color printer according to still another embodiment of the invention. This printer includes print heads 4*a*–4*d* and a carriage 1, which are identical with the heads and the carriages of the foregoing printers. The descriptions of these parts will not be repeated.

Figure 15:
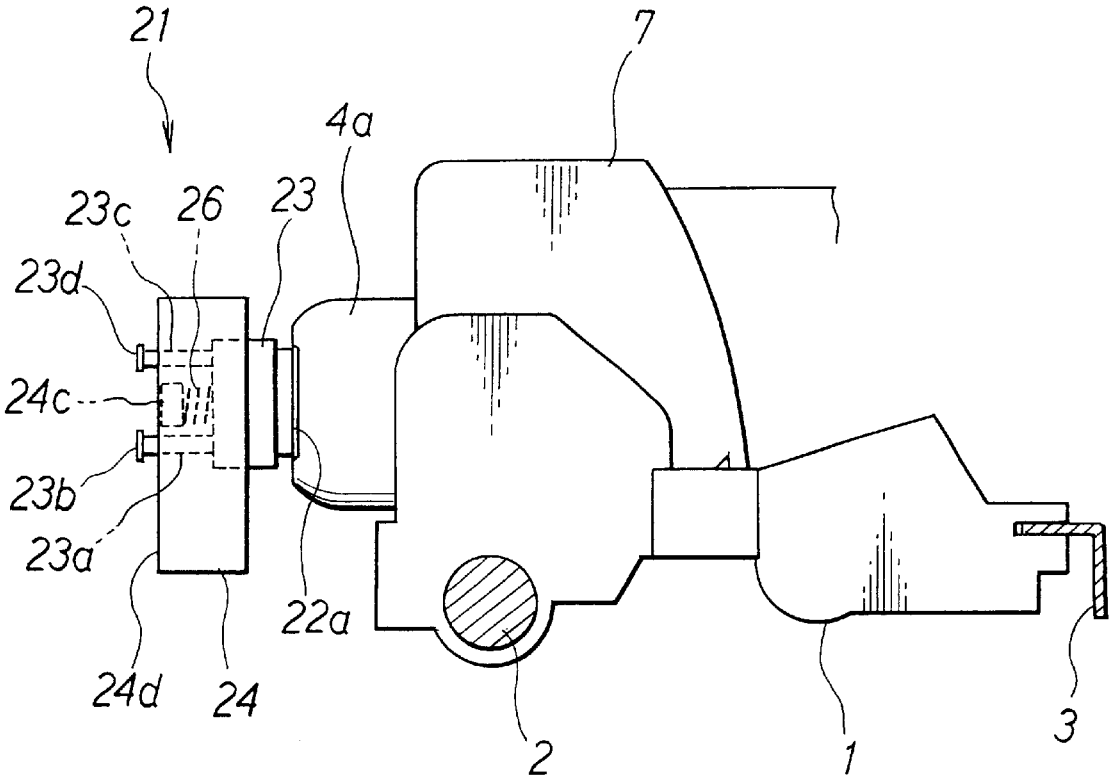
FIG. 15 is a schematic side view of the capping device, the carriage, a print head, etc. of an ink jet color printer according to a third embodiment of the invention.

As shown in FIG. 15, the capping device 21 is substantially identical in structure with that of the last mentioned printer. The upper and lower legs 23*c* of each cap holder 23 are equal in length, and have stoppers 23*d* and 23*b* formed on their respective rear ends. The holders 23 can move forward and backward, and can incline up and down within a predetermined range.

Figure 16:
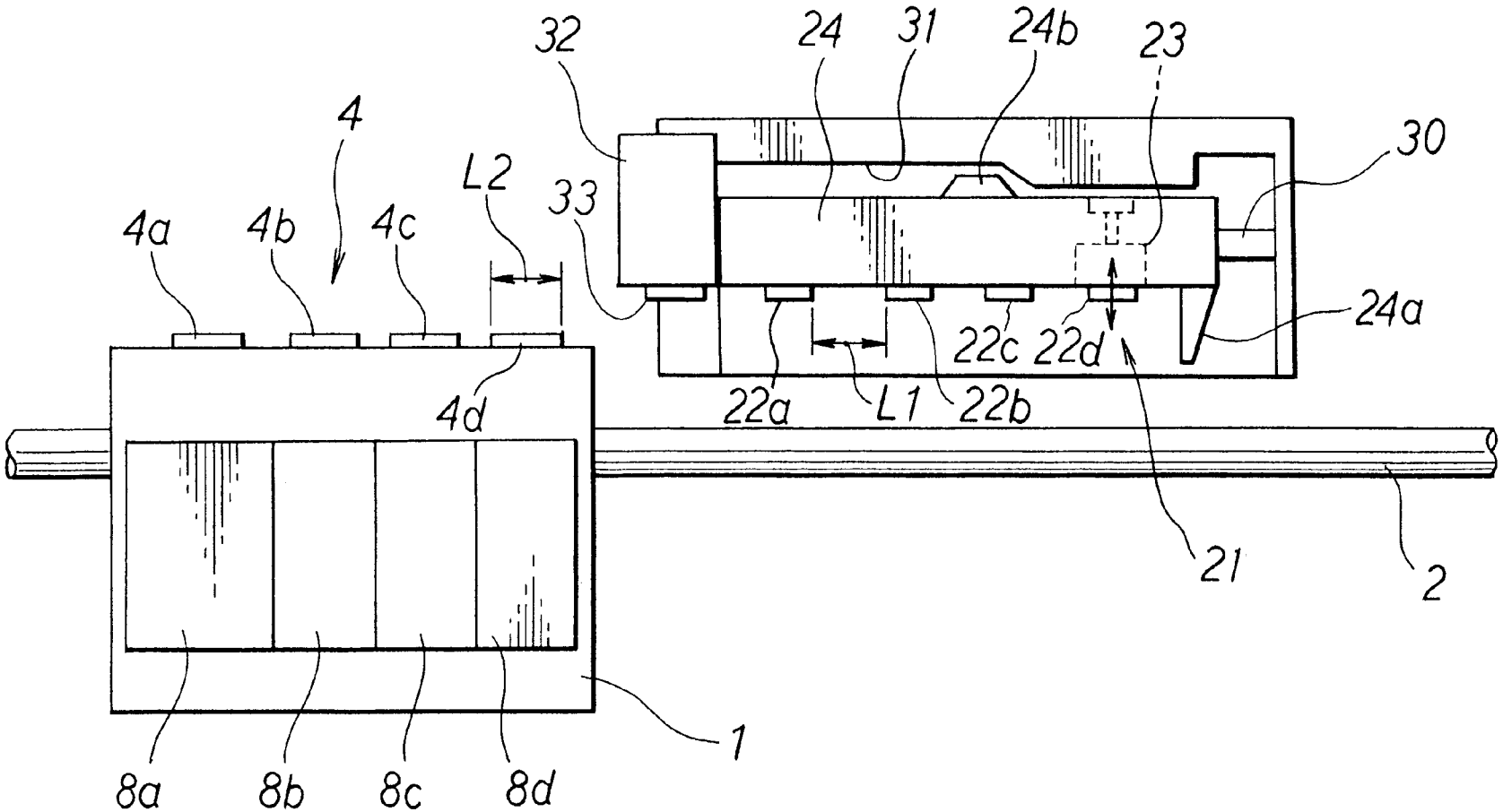
FIG. 16 is a schematic top view of the capping device, the carriage, etc. of the printer according to the third embodiment.

As shown in FIG. 16, the protective caps 22*a*–22*d* are spaced at intervals L1, each of which is longer than the width L2 of each of the print heads 4*a*–4*d*.

Figure 17A:
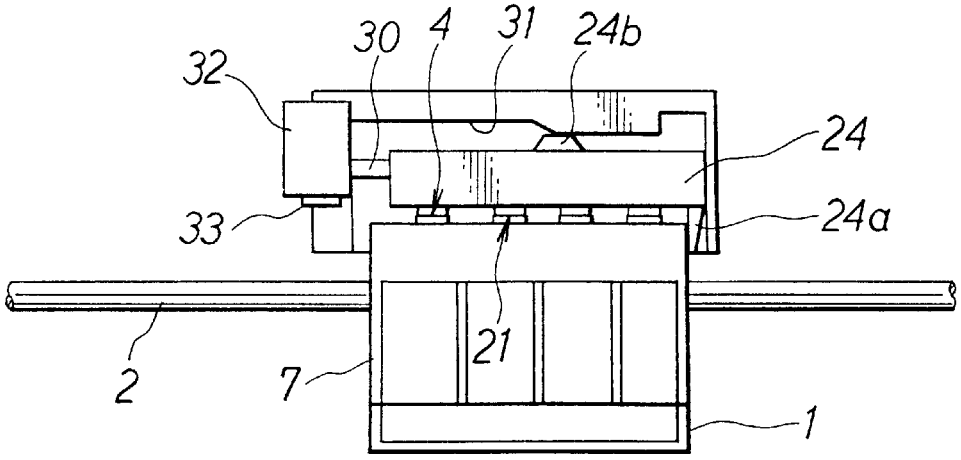
FIGS. 17A, 17B and 17C are schematic top views of the capping device, the carriage, etc. of the printer according to the third embodiment, showing the operation of the capping device.
Figure 17B:
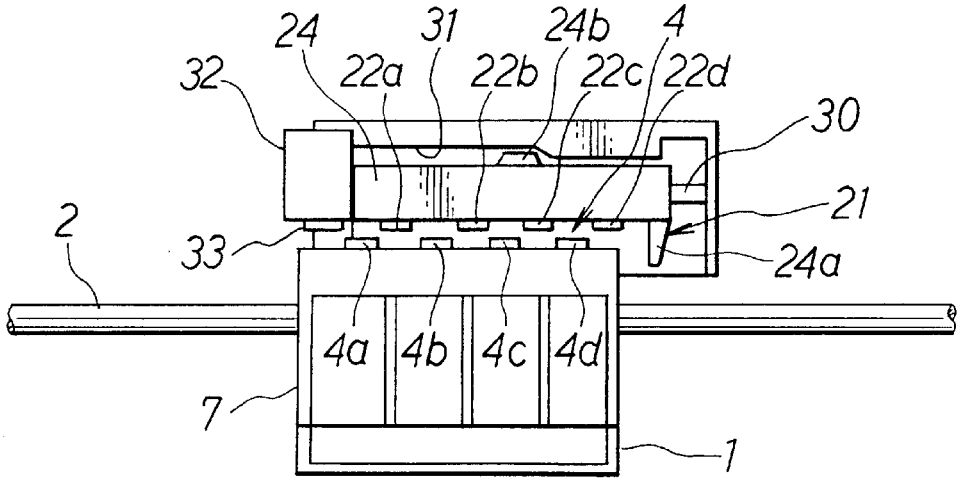

While no printing is carried out, the controller 71 of this printer stops the carriage 1 at a capping position, as shown in FIG. 17A, where the protective caps 22*a*–22*d* cap the print heads 4*a*–4*d* closely. While the print head 4 is replaced, the controller 71 stops the carriage 1 at a replacing position, as shown in FIG. 17B, where the heads 4*a*–4*d* are displaced from the caps 22*a*–22*d* in the directions in which the carriage reciprocates. The replacing position is interposed between the capping position and the printing paper.

If one of the switches 75 is operated to replace the head unit 4, the carriage 1 moves from the capping position (FIG. 17A) to the replacing position (FIG. 17B) and stops at this position. When the carriage 1 moves to the replacing position, the protective caps 22*a*–22*d* are returned by the force of a spring (not shown) to the initial position a little away from the print heads 4*a*–4*d*, and the caps 22*a*–22*d* alternate with the heads 4*a*–4*d* in the directions in which the carriage reciprocates.

Figure 17C:
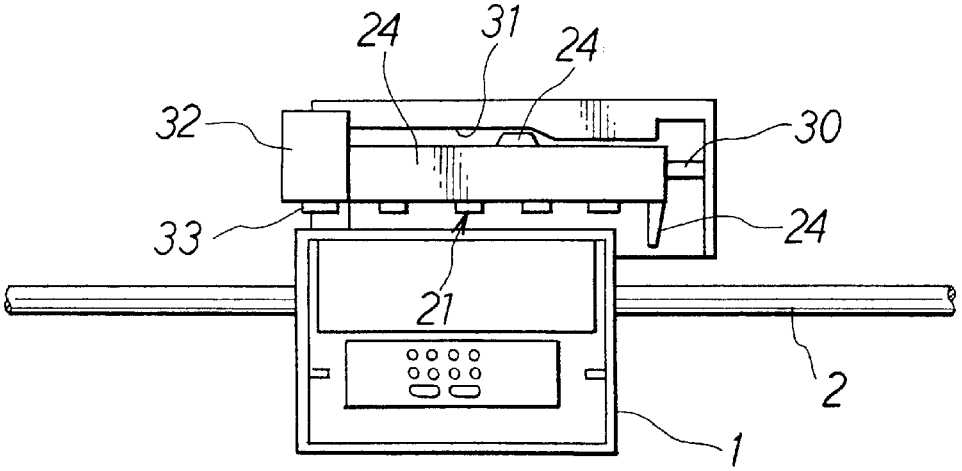

Then, as shown in FIG. 17C, the head holder 7 is removed from the carriage 1. Instead, as shown in FIG. 17B, a new head holder 7 with a new head unit 4 is mounted on the carriage 1 in the foregoing way. When the holder 7 is mounted, the print heads 4*a*–4*d* alternate with the protective caps 22*a*–22*d*. Besides, each cap interval LI is longer than the head width L2. Therefore, even if the holder 7 is put on the carriage 1, as shown with two-dot chain lines in FIG. 13, with the heads 4*a*–4*d* inclined from their normal position toward the caps 22*a*–22*d*, each head is positioned between two adjacent protective caps or between the suction cap 33 and the adjacent protective cap. This keeps the heads 4*a*–4*d* out of contact with the caps 22*a*–22*d* and 33. Consequently, the caps 22*a*–22*d* and 33 do not rub on the ejection faces of the heads 4*a*–4*d*.

After the head holder 7 is replaced, the carriage 1 is returned to the capping position shown in FIG. 17A, where the protective caps 22*a*–22*d* cap the print heads 4*a*–4*d*.

Figure 18A:
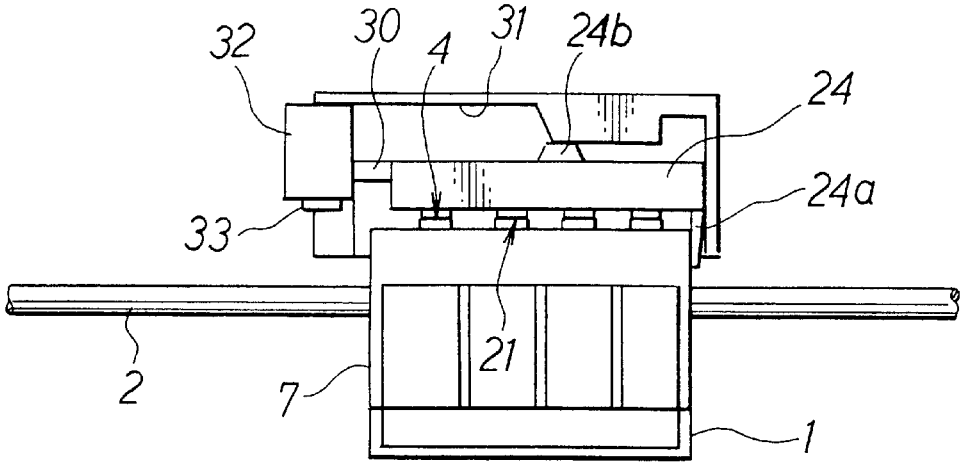
FIGS. 18A, 18B and 18C are schematic top views of the capping device, the carriage, etc. of a printer according to a fourth embodiment of the invention, showing the operation of the capping device.
Figure 18B:
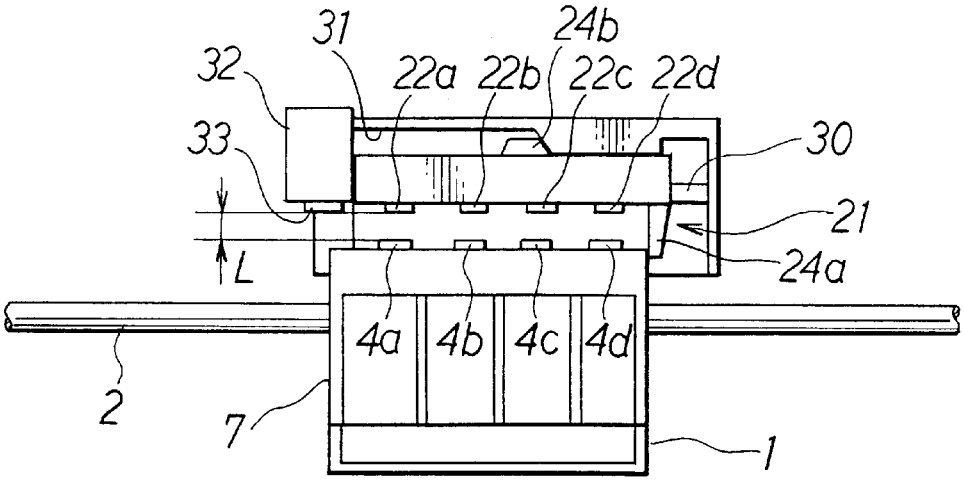
Figure 18C:
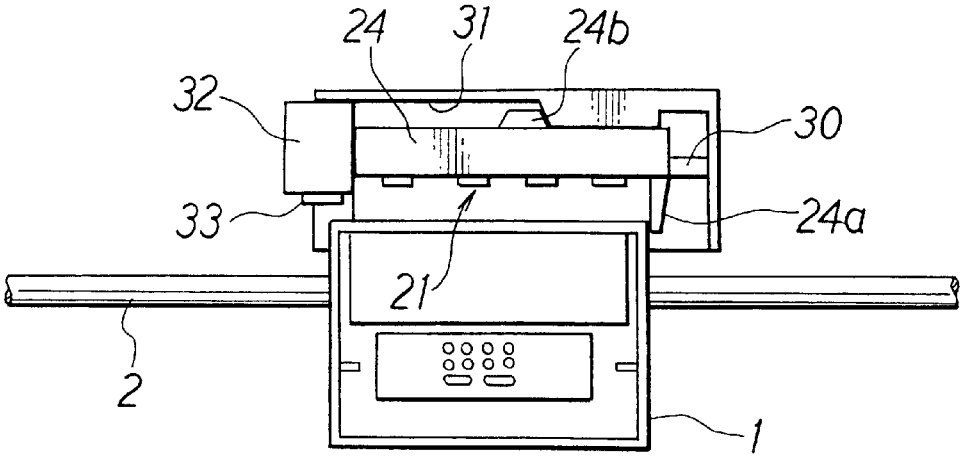

FIGS. 18A, 18B and 18C show the capping device 21 etc. of an ink jet color printer according to yet another embodiment of the invention. The print heads 4*a*–4*d*, the carriage 1 and the capping device 21 of this printer are identical with those of the last mentioned printer. The descriptions of these parts will not be repeated.

When the protrusion 24*b* on the casing 24 of this capping device 21 is away from the inclined cam 31 toward the printing area, the protective caps 22*a*–22*d* are spaced at a distance L from the print heads 4*a*–4*d* perpendicularly to the direction in which the carriage 1 reciprocates. The distance L is such that, when the heads 4*a*–4*d* are mounted in the foregoing way, the caps 22*a*–22*d* are positioned outside the loci described by the front ends of the heads turning around the cylindrical pins 7*b*. The distance L depends on the height of the protrusion 24*b* or the difference of elevation between the top and the bottom of the inclined cam 31.

While no printing is carried out, the controller 71 of this printer stops the carriage 1 at a capping position, as shown in FIG. 18A, where the protective caps 22*a*–22*d* cap the print heads 4*a*–4*d* closely. While the print head 4 is replaced, the controller 71 stops the carriage 1 at a replacing position, which is displaced from the capping position toward the printing area, as shown in FIG. 18B.

If one of the switches 75 is operated to replace the head unit 4, the carriage 1 moves from the capping position (FIG. 18A) to the replacing position (FIG. 18B) and stops at this position. Then, as shown in FIG. 18C, the head holder 7 is removed from the carriage 1. Instead, as shown in FIG. 18B, a new head holder 7 is mounted in the foregoing way.

When the head holder 7 is mounted, as shown in FIG. 18B, the print heads 4*a*–4*d* are spaced at the distance L from the protective caps 22*d*–22*d*. Therefore, even if the holder 7 is put on the carriage 1, with the heads 4*a*–4*d* inclined from their normal position toward the caps 22*a*–22*d*, the heads do not come into contact with the caps. This prevents the protective caps 22*a*–22*d* from rubbing on the ejection faces of the heads 4*a*–4*d*.

After the head holder 7 is replaced, the carriage 1 is returned to the capping position shown in FIG. 18A.

When the carriage 1 of each printer returns, the action of a spring returns the protective caps 22*a*–22*d* toward the printing area, and moves them away from the ejection faces of the print heads 4*a*–4*d*. The inclined cam of each printer might be varied in shape etc. to use a spring for urging the protective caps toward the ejection faces of the print heads. It would be possible to omit the spring by forming a cam groove for guiding the movement of the protective caps.

Ink droplets can be ejected obliquely from the print heads 4*a*–4*d* of each printer. The invention may, however, be applied to another printer including print heads and a carriage which are positioned vertically or horizontally so that ink droplets can be ejected vertically or horizontally.

The invention has been described hereinbefore in detail as specific examples, to which it is not limited. The invention may include various modifications and improvements obvious in view of the examples to those skilled in the art.

Figure 19A:
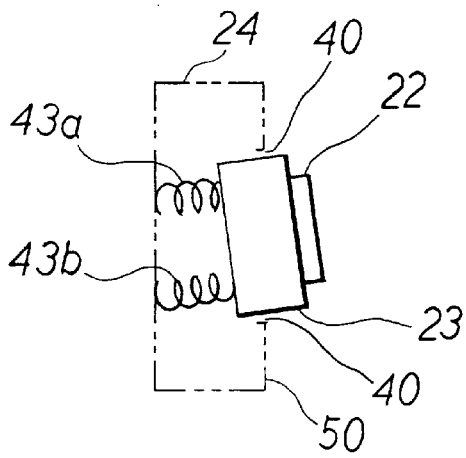
FIG. 19A is a schematic cross section of the capping device of a printer according to the first or second aspect of the invention.

FIG. 19A shows a capping device which may replace the capping device 21 shown specifically in FIG. 5. The device shown in FIG. 19A includes four protective caps 22, four cap holders 23 and a casing 24, which includes a front wall 50 and a rear wall. Each cap holder 23 holds one of the caps 22 on its front side. An upper spring 43*a* and a lower spring 43*b* are interposed between the rear side of each cap holder 23 and the rear wall of the casing 24. The springs 43*a* and 43*b* for the four cap holders 23 urge these holders toward the print heads. The upper springs 43*a* are shorter than the lower springs 43*b*. Consequently, when the head holder is not mounted on the carriage, the caps 22 are oriented opposite the direction in which the head holder moves to be mounted. The front wall 50 of the casing 24 has four openings 40 formed through it, which are large enough for each cap holder 23 to move in one of them. When the head holder is introduced onto the carriage, as is the case with the relationship between the head holder 7 and the cap holders 23 shown in FIGS. 9A–9C, the ejection faces of the print heads come into contact with the caps 22. When the head holder turns subsequently, the caps holders 23 can turn, following it, with the caps 22 in close contact with the ejection faces. That is to say, the springs 43*a* and 43*b* are so adjusted and the openings 40 are so sized that, when the head holder turns to be mounted on the carriage, the cap holders 23 can follow the turning loci of the ejection faces.

Figure 19B:
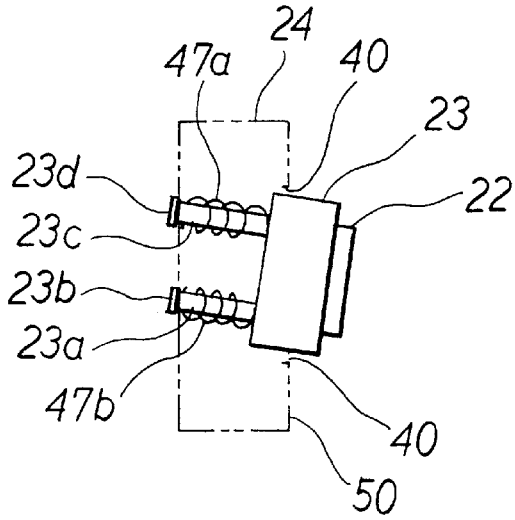
FIGS. 19B and 19C are schematic cross sections of the capping devices of printers according to the third aspect of the invention.

FIG. 19B shows a capping device which may replace the capping device 21 shown in FIG. 12A. With reference to FIG. 19B, each longer leg 23*c* is surrounded by a spring 47*a*, and each shorter leg 23*a* is surrounded by a spring 47*b*, in place of the springs 26 shown in FIG. 12A.

Figure 19C:
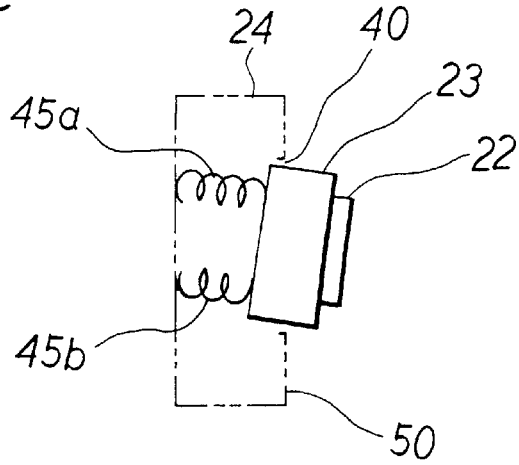
Figure 20:
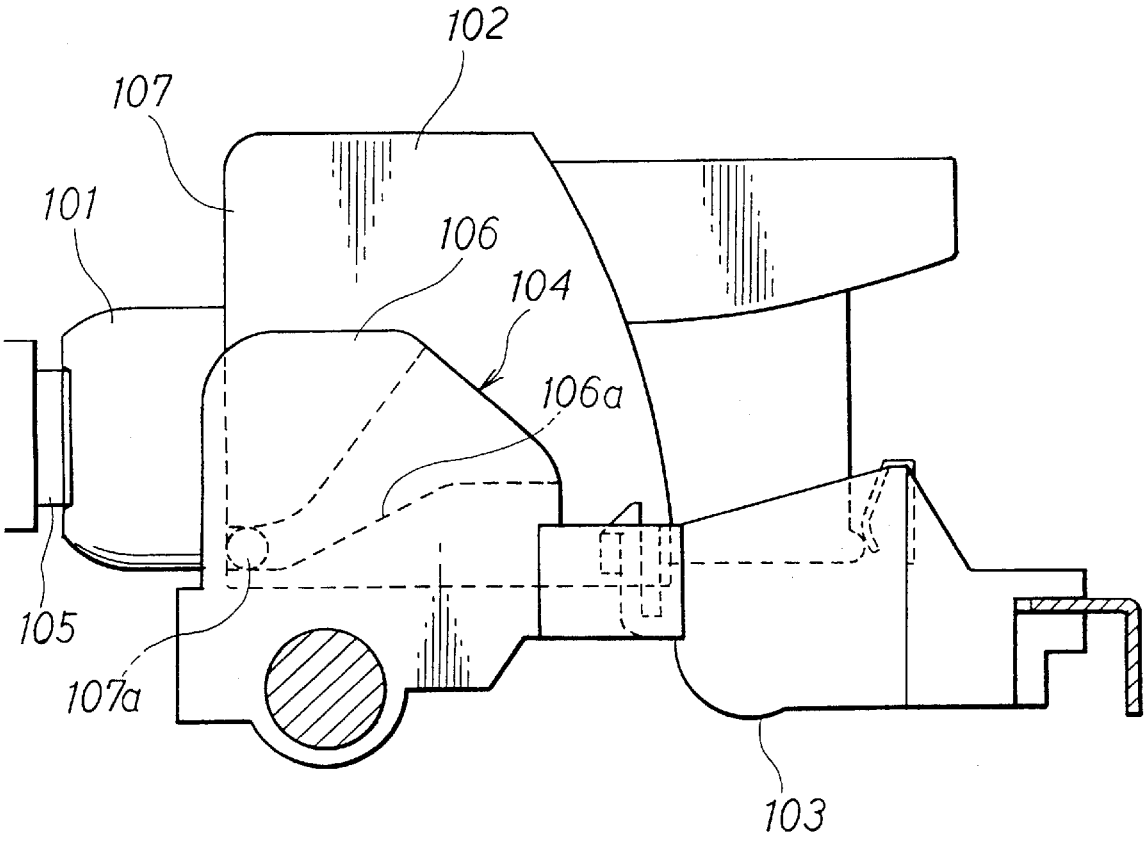
Fig. 20 PRIOR ART
FIG. 20 is a side view of parts of a conventional printer.
Figure 21A:
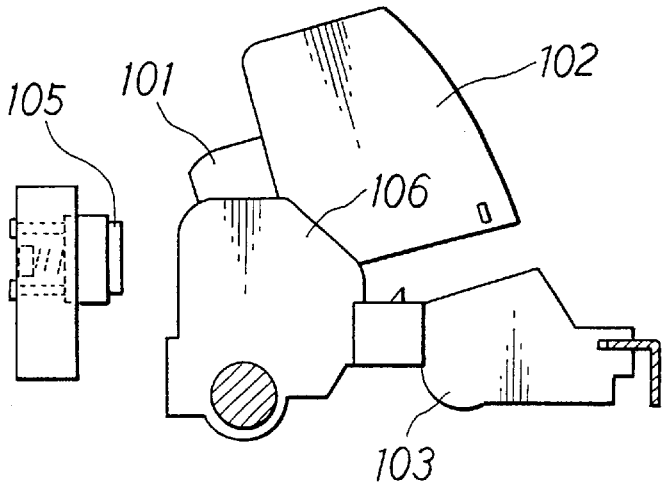
Fig. 21A PRIOR ART
FIGS. 21A, 21B and 21C are side views of parts of the conventional printer, showing the operation of parts.
Figure 21B:
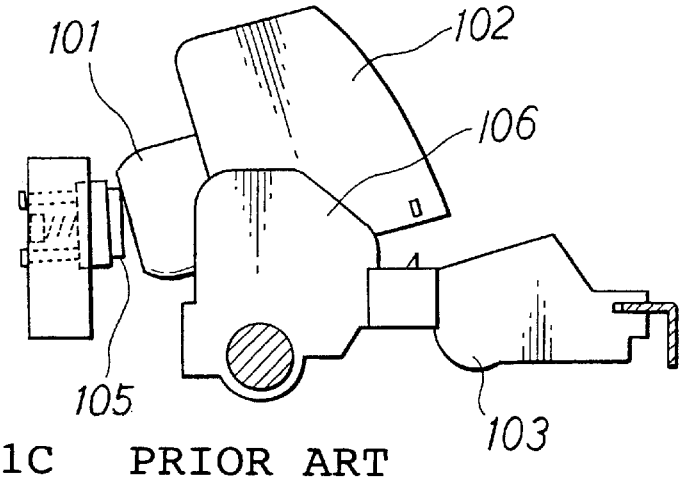
Fig. 21B PRIOR ART
Figure 21C:
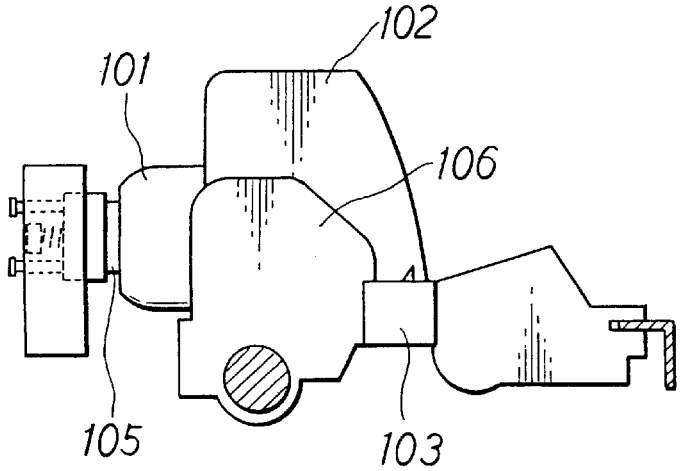
Fig. 21C PRIOR ART
Figure 22A:
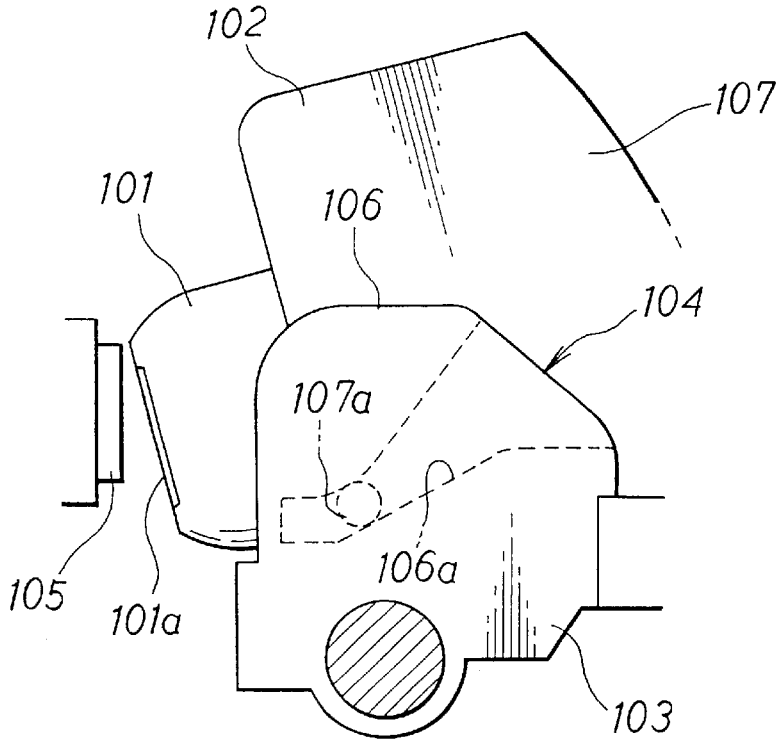
Fig. 22A PRIOR ART
FIGS. 22A and 22B are further side views of parts of the conventional printer, showing the operation of parts.
Figure 22B:
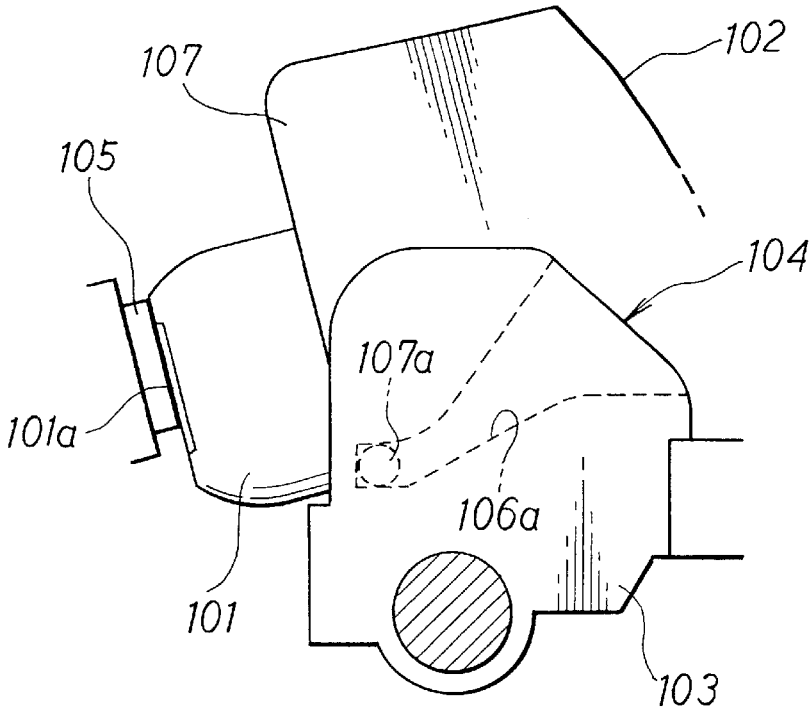
Fig. 22B PRIOR ART

FIG. 19C shows another capping device which may replace the capping device 21 shown in FIG. 12A. With reference to FIG. 19C, each cap holder 23 is supported by two longer springs 45*a* and two shorter springs 45*b*, in place of the legs 23*c* and 23*a* and the spring 26 shown in FIG. 12A. This makes the capping device simpler in structure. The lengths and forces of the springs 45*a* and 45*b* are so designed that, when the head holder is turned to be mounted on the carriage, with the ejection faces of the print heads turned, the cap holders 23 can turn and the protective caps 22 can finally come into contact with the ejection faces, as is the case with the device in FIG. 19B.

What is claimed is:

1. A printer comprising:

a print head having an ejection face and a nozzle formed thereon for ejecting ink onto a printing medium;

a head holder for holding the print head;

a capping mechanism including a protective cap for covering the ejection face at a capping position where the cap faces the ejection face;

a carriage for mounting the head holder, movable in opposite reciprocating directions between a printing area where the carriage faces the printing medium and a capping area where the carriage faces the capping mechanism; and a carriage controller for moving the carriage in the capping area to move the carriage to a replacing position for replacing the print head in the capping area off the capping position when the head holder is to be mounted on the carriage.

2. The printer as defined in claim 1, wherein the print head comprises a plurality of sub-heads arranged in the reciprocating directions, the protective cap comprises sub-caps each associated with one of the sub-heads, the sub-heads being displaced in the reciprocating directions from the sub-caps in the replacing position.

3. The printer as defined in claim 1, wherein the, the head holder includes a protrusion formed on at least one side and the carriage includes a support, the support rotatably supporting the protrusion; and a guide for guiding the protrusion to the support.

4. The printer as defined in claim 3, wherein, the head holder is mountable on the carriage by moving the head holder along the guide until the protrusion arrives at the support and, thereafter, turning the head holder around a turning axis, the turning axis being a centerline through the protrusion at the support.

5. The printer as defined in claim 3, wherein, while at the replacing position, the protective cap is off the ejection face of the print head when the head holder turns around the turning axis.

6. The printer as defined in claim 1, wherein when the head holder is turned around, the turning axis, the ejection face of the print head is out of contact with the protective cap.

7. The printer as defined in claim 1, and further comprising a guide rod extending in the reciprocating directions, the carriage being supported slidably on the rod, the capping mechanism includes:

a frame having a slope inclined with respect to the guide rod;

a guide shaft supported by the frame between the slope and the guide rod, the shaft extending in parallel with the rod; and a casing supported rotatably on and slidably along the guide shaft, the casing supporting the protective cap, the casing including a first part for engaging with the carriage and a second part for sliding on the slope;

whereby, when the carriage moves to the capping area, the carriage engages with the first part of the casing, thereby sliding the second part on the slope to turn the casing around the guide shaft so that the protective cap approaches the ejection face.

8. The printer as defined in claim 1, and further comprising an outer casing housing the carriage and the capping mechanism, the casing having an opening through which the capping area can be accessed and the head holder can be mounted on the carriage.

9. The printer as defined in claim 1, which is an ink jet printer.

* * * * *